US009629415B2

(12) United States Patent
Cortez et al.

(10) Patent No.: US 9,629,415 B2
(45) Date of Patent: Apr. 25, 2017

(54) SOLE STRUCTURE FOR AN ARTICLE OF FOOTWEAR

(75) Inventors: Margarita Cortez, Beaverton, OR (US); Fred G. Fagergren, Hillsboro, OR (US); Klaas P. Hazenberg, Guangzhou (CN); Eric S. Schindler, Beaverton, OR (US); Camden Stanke, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 942 days.

(21) Appl. No.: 13/556,872

(22) Filed: Jul. 24, 2012

(65) Prior Publication Data

US 2014/0026438 A1 Jan. 30, 2014

(51) Int. Cl.

| | |
|---|---|
| ***A43B 13/18*** | (2006.01) |
| ***A43B 13/12*** | (2006.01) |
| ***A43B 13/22*** | (2006.01) |

(52) U.S. Cl.

CPC ..... *A43B 13/181* (2013.01); *A43B 13/122* (2013.01); *A43B 13/184* (2013.01); *A43B 13/223* (2013.01)

(58) Field of Classification Search

CPC ..... A43B 13/181; A43B 7/144; A43B 13/18; A43B 13/187; A43B 7/32; A43B 13/141; A43B 7/1445; A43B 7/142; A43B 13/189; A43B 13/12; A43B 13/125; A43B 13/14;

(Continued)

(56) References Cited

U.S. PATENT DOCUMENTS

| | | | | |
|---|---|---|---|---|
| 3,757,774 A * | 9/1973 | Hatuno | ..... | 601/28 |
| 4,141,158 A * | 2/1979 | Benseler et al. | ..... | 36/32 R |
| 4,535,553 A | 8/1985 | Derderian et al. | | |

(Continued)

FOREIGN PATENT DOCUMENTS

| | | | | |
|---|---|---|---|---|
| CA | 1255496 * | 6/1989 | ..... | A43B 1/10 |
| CA | 1255496 A | 6/1989 | | |

(Continued)

OTHER PUBLICATIONS

Sep. 1, 2015 (CN)—Office Action App. 201380038814.8.

(Continued)

*Primary Examiner* — Anna Kinsaul
*Assistant Examiner* — Catherine M Ferreira
(74) *Attorney, Agent, or Firm* — Banner & Witcoff, Ltd.

(57) ABSTRACT

A sole structure for an article of footwear includes one or more outsole portions. At least some of these outsole portions include a plurality of alternating upward-facing and downward-facing elongate channels. The channels may have a base and two sidewalls, with adjacent channels sharing a common sidewall. The bases of the downward-facing channels form an upper surface of the outsole portion and the bases of the upward-facing channels form a lower surface of the outsole portion. The sidewalls are arranged at non-perpendicular angles to the upper surface. A first outsole portion has a pressure-versus-strain curve having a local maximum at a "trip point" pressure value and a first strain value and wherein the pressure-versus-strain curve has a change in strain of at least approximately 10% before a second occurrence of the "trip point" pressure value is reached. An article of footwear having the sole structure attached to an upper is also provided.

23 Claims, 23 Drawing Sheets

(58) Field of Classification Search
CPC ..... A43B 13/20; A43B 13/127; A43B 13/16; A43B 13/184; A43B 13/183
USPC ..... 36/28, 59 C, 103
See application file for complete search history.

(56) References Cited

U.S. PATENT DOCUMENTS

| | | | | |
|---|---|---|---|---|
| 4,754,559 | A | 7/1988 | Cohen | |
| 5,216,824 | A * | 6/1993 | Blissett et al. | 36/28 |
| 5,337,492 | A | 8/1994 | Anderie et al. | |
| 5,686,167 | A | 11/1997 | Rudy | |
| 5,822,886 | A | 10/1998 | Luthi et al. | |
| 5,862,614 | A * | 1/1999 | Koh | 36/31 |
| 6,156,539 | A | 12/2000 | Johnson et al. | |
| 6,516,539 | B2 | 2/2003 | Nishiwaki et al. | |
| 6,691,432 | B2 | 2/2004 | Masseron | |
| 6,874,252 | B2 | 4/2005 | Nakano | |
| 6,931,768 | B2 | 8/2005 | Baek | |
| 7,013,582 | B2 | 3/2006 | Lucas et al. | |
| 7,181,866 | B2 | 2/2007 | Braunschweiler | |
| 7,191,550 | B2 | 3/2007 | Baek | |
| 7,458,172 | B2 | 12/2008 | Aveni | |
| 7,574,817 | B2 | 8/2009 | Fechter | |
| 7,665,229 | B2 | 2/2010 | Kilgore et al. | |
| 8,322,049 | B2 * | 12/2012 | Dojan | 36/59 C |
| 2009/0211114 | A1 | 8/2009 | Ivester et al. | |
| 2009/0265868 | A1 | 10/2009 | Aveni | |
| 2010/0011622 | A1 | 1/2010 | Abadjian | |
| 2010/0281714 | A1 | 11/2010 | Carboy et al. | |
| 2011/0016746 | A1 * | 1/2011 | Callahan et al. | 36/28 |
| 2011/0016749 | A1 | 1/2011 | Callahan et al. | |
| 2012/0167412 | A1 | 7/2012 | Braunschweiler | |

FOREIGN PATENT DOCUMENTS

| | | | |
|---|---|---|---|
| CN | 101961158 | A | 2/2011 |
| EP | 1858358 | A1 | 11/2007 |
| EP | 2277402 | A2 | 1/2011 |
| JP | H05309001 | A | 11/1993 |

OTHER PUBLICATIONS

Mar. 1, 2016 (EP)—Office Action App. 13745285.0.
May 12, 2016 (CN)—Office Action App. 201380038814.8.
International Search Report and Written Opinion issued Dec. 3, 2013 in corresponding International Patent Application No. PCT/US2013/051621.

* cited by examiner

SOLE STRUCTURE FOR AN ARTICLE OF FOOTWEAR

FIELD

Aspects of the present invention relate to sole structures for articles of footwear. More particularly, various examples relate to outsole structures having improved impact-attenuation and/or energy-absorption.

BACKGROUND

To keep a wearer safe and comfortable, footwear is called upon to perform a variety of functions. For example, the sole structure of footwear should provide adequate support and impact force attenuation properties to prevent injury and reduce fatigue, while at the same time provide adequate flexibility so that the sole structure articulates, flexes, stretches, or otherwise moves to allow an individual to fully utilize the natural motion of the foot.

High-action sports, such as the sport of skateboarding, impose special demands upon players and their footwear. For example, during any given run, skateboarders perform a wide variety of movements or tricks (e.g., carving, pops, flips, ollies, grinding, twists, jumps, etc.). During all of these movements, pressure shifts from one part of the foot to another, while traction between the skateboarder and the skateboard must be maintained. Further, for the street skateboarder, traction between the skateboarder's shoe and the ground propels the skateboarder.

Additionally, skateboarding requires the skateboarder to apply pressure to one or the other portions of the skateboard using his or her feet in order to control the board. This requires that skateboarders selectively apply pressure to the board through their shoes at different locations on the bottom and edges of the shoes. For example, for some skateboarding tricks, pressure is applied along the lateral edge of the foot, approximately at the outer toe line location. For other tricks, pressure is applied on the lateral edge of the foot somewhat forward of the outer toe line location. As the interaction between the skateboarder and the skateboard is particularly important when performing such tricks, skateboarders typically prefer shoes having relatively thin and flexible soles that allow the skateboarder to "feel" the board.

Importantly, however, over the past several years skateboard tricks have become "bigger," involving higher jumps and more air time. These bigger skateboard tricks may result in uncomfortably high, even damaging, impact loads being felt by the skateboarder. Further, during many of the movements and particularly upon landing, significant impact loads may be experienced by various portions of the foot.

Accordingly, it would be desirable to provide footwear that allows the wearer to better feel and grip the ground or other foot-contacting surfaces, to achieve better dynamic control of the wearer's movements, while at the same time providing impact-attenuating features that protect the wearer from impacts due to these dynamic movements.

BRIEF SUMMARY

According to aspects of the invention, a sole structure for an article of footwear has one or more outsole portions. At least one of these outsole portions has a plurality of alternating upward-facing and downward-facing elongate channels. The channels may have a base element and two sidewalls, with adjacent upward-facing and downward-facing channels sharing a common sidewall. The base elements of the downward-facing channels form an upper surface of each outsole portion and the base elements of the upward-facing channels form a lower surface of each outsole portion. A first outsole portion has a pressure-versus-strain curve having a local maximum at a "trip point" pressure value and a first strain value and the pressure-versus-strain curve has a change in strain of at least approximately 10% before a second occurrence of the "trip point" pressure value is reached.

According to certain aspects, the first outsole portion may have a local minimum pressure value between the first and second occurrences of the "trip point" pressure value, and the local minimum pressure value may be greater than approximately 70% of the "trip point" pressure value.

According to other aspects, the first outsole portion may have a pressure-carrying capacity between the first and second occurrences of the "trip point" pressure value that varies by less than or equal to approximately 20% over a change in strain of at least approximately 15%.

According to further aspects, the first outsole portion may absorb a first amount of energy per unit area at the first occurrence of the "trip point" pressure value and absorb a second amount of energy per unit area between the first and second occurrences of the "trip point" pressure value. The value of the second energy per unit area may be at least 70% of the value of the first energy per unit area.

According to some aspects, the first outsole portion may have a height dimension of less than or equal to 8.0 mm, measured from the upper surface to the lower surface. The first outsole portion may absorb an energy per unit area of at least 600 J/mm$^2$ without exceeding a pressure of 350 kPa. Alternatively, the first outsole portion may absorb an energy per unit area of at least 900 J/mm$^2$ without exceeding a pressure of 500 kPa. Also, alternatively, the first outsole portion may absorb an energy per unit area of at least 1100 J/mm$^2$ without exceeding a pressure of 700 kPa.

According to other aspects, the first outsole portion may have a "trip point" pressure value of between approximately 250 kPa and approximately 450 kPa, or alternatively, the first outsole portion may have a "trip point" pressure value of between approximately 450 kPa and approximately 650 kPa.

According to even other aspects, the upward-facing channels of the first outsole portion may undulate in the plane of the sole. Thus, for example, when viewed perpendicular to the plane of the sole (e.g., when viewed from above or from below), the channels may have a zigzag, sinusoidal, sawtoothed, or other regular or irregular wave-like configuration. Further, when viewed perpendicular to the plane of the sole, the base elements of the upward-facing channels (i.e., the lower base elements) may also have the zigzag (or other wave-like) configuration. Similarly, the downward-facing channels of the first outsole portion may undulate in the plane of the sole. Thus, as an example, when viewed perpendicular to the plane of the sole, the channels may have a zigzag, sinusoidal, sawtoothed, or other regular or irregular wave-like configuration. Correspondingly, when viewed perpendicular to the plane of the sole, the base elements of the downward-facing channels (i.e., the upper base elements) may have an undulating, wave-like configuration. The undulating configuration(s) of the lower base elements may be the same as the undulating configuration(s) of the upper base elements. Optionally, the undulating configuration(s) of the lower base elements may be different than the undulating configuration(s) of the upper base elements.

According to some aspects, the sidewalls of the channels may form acute, perpendicular, or obtuse angles from the upper surface. In some example embodiments, the angles of the sidewalls to the upper surface of the first outsole portion may be greater than or equal to approximately 70 degrees. The widths of the bases of the downward-facing channels of the first outsole portion may be approximately 3.0 mm and the widths of the bases of the upward-facing channels of the first outsole portion may be less than approximately 1.25 mm. The thickness of the sidewalls of the first outsole portion may be between approximately 0.8 mm and approximately 1.5 mm. The thickness of the bases of the upward-facing channels of the first outsole portion may be between approximately 1.0 mm and approximately 1.5 mm.

According to another aspect of the invention, a sole structure for an article of footwear includes one or more outsole portions. Each outsole portion has a plurality of alternating upward-facing and downward-facing elongate channels. Each channel has a base and two sidewalls, with adjacent upward-facing and downward-facing channels sharing a common sidewall. The bases of the downward-facing channels form an upper surface of each outsole portion and the bases of the upward-facing channels form a lower surface of each outsole portion. The sidewalls are arranged at a non-perpendicular angle to the upper surface of the first outsole portion. A first outsole portion has a monotonically increasing vertical pressure-carrying capacity as a function of strain, as measured over a 40 mm diameter area, until a local maximum "trip point" pressure value is reached. Beyond this first occurrence of the "trip point" pressure value the first outsole portion has a local minimum pressure value that is between 60% to 100% of the "trip point" pressure value.

An article of footwear including an upper attached to the sole structure disclosed herein is also provided.

BRIEF DESCRIPTION OF THE DRAWINGS

The foregoing Summary, as well as the following Detailed Description, will be better understood when read in conjunction with the accompanying drawings.

Figure 1A:
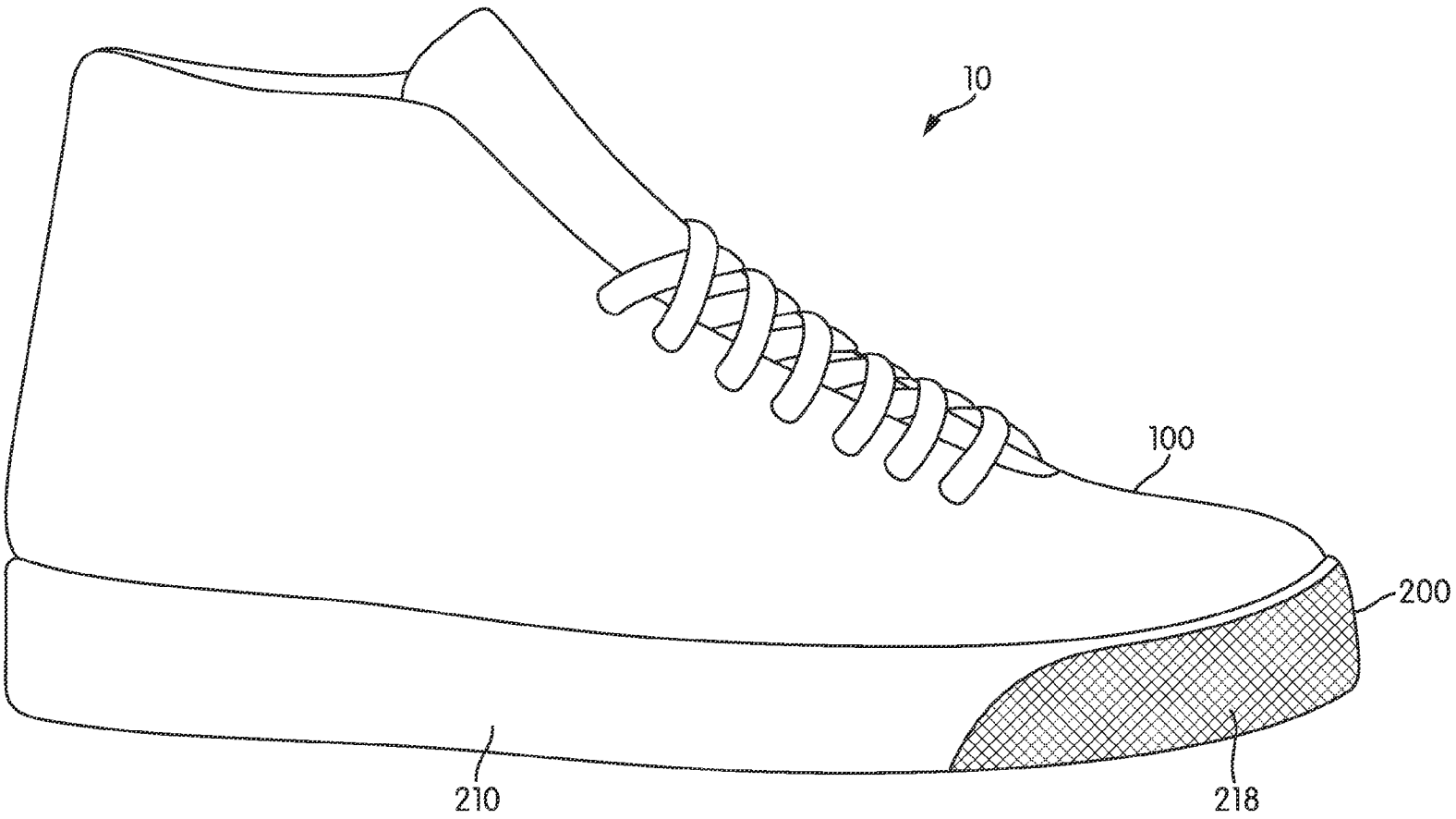
FIG. 1A is a perspective view, looking from the lateral side, of an article of footwear having an upper and a sole structure in accordance with aspects of this disclosure.

It should be understood that the appended drawings are not necessarily to scale, presenting a somewhat simplified representation of various features illustrative of specific aspects of the invention. Certain features of the illustrated embodiments may have been enlarged or distorted relative to others to facilitate visualization and clear understanding. In particular, thin features may be thickened, for example, for clarity of illustration.

DETAILED DESCRIPTION

The following discussion and accompanying figures disclose articles of footwear having sole structures with sole geometries in accordance with various embodiments of the present disclosure. Concepts related to the sole geometry are disclosed with reference to a sole structure for an article of athletic footwear having a configuration suitable for the activity of skateboarding. However, the disclosed sole structure is not solely limited to footwear designed for skateboarding, and may be incorporated into a wide range of athletic footwear styles, including shoes that are suitable for rock climbing, bouldering, hiking, running, baseball, basketball, cross-training, football, rugby, tennis, volleyball, and walking, for example. In addition, a sole structure according to various embodiments as disclosed herein may be incorporated into footwear that is generally considered to be non-athletic, including a variety of dress shoes, casual shoes, sandals, slippers, and boots. An individual skilled in the relevant art will appreciate, given the benefit of this specification, that the concepts disclosed herein with regard to the sole structure apply to a wide variety of footwear styles, in addition to the specific styles discussed in the following material and depicted in the accompanying figures.

Sports generally involve consistent pounding of the foot and/or periodic high impact loads on the foot. For example, skateboarding is a sport that is known to involve high impact loading under the foot, especially when unsuccessfully or awkwardly landing tricks and/or inadvertently coming off the board on hard, unforgiving surfaces. Over the past several years, skateboarding tricks have gotten much bigger, resulting in even higher impact loads, especially in the medial and the heel regions of the foot. This is true whether the foot remains on the board during landing or, alternatively, if the landing is off the board. It is not unheard of for skateboarders to experience heel bruising and even micro-fractures.

A sole structure for an article of footwear having an impact-attenuation system capable of handling the high "big trick" impact loads, without sacrificing the intimate feel for the board desired by skateboarders, is sought. Thus, it may be advantageous to have a sole structure that responds somewhat stiffly when a user is walking or performing relatively low impact ambulatory activities, thereby maintaining a feel for the ground surface (or board), and that also responds more compliantly when the user is performing higher impact maneuvers, thereby lessening any excessively high impact pressures that would otherwise be experienced by the user.

In addition, the ability to "grip" the board is another important feature desired by skateboarders. Softer materials tend to provide higher coefficients of friction and, thus, generally provide better traction and "grip" than harder materials. However, softer materials also tend to wear out more quickly. Thus, another feature sought by skateboarders is a durable sole. Indeed, skateboarders and many other athletes desire sole structures that provide high traction and lasting durability Even further, skateboarders and many other athletes desire sole structures that are light weight and low profile.

Various aspects of this disclosure relate to articles of footwear having a sole structure with an outsole structure capable of absorbing impact energies and mitigating impact loads.

As used herein, the modifiers "upper," "lower," "top," "bottom," "upward," "downward," "vertical," "horizontal," "longitudinal," "transverse," "front," "back" etc., unless otherwise defined or made clear from the disclosure, are relative terms meant to place the various structures or orientations of the structures of the article of footwear in the context of an article of footwear worn by a user standing on a flat, horizontal surface.

Figure 1B:
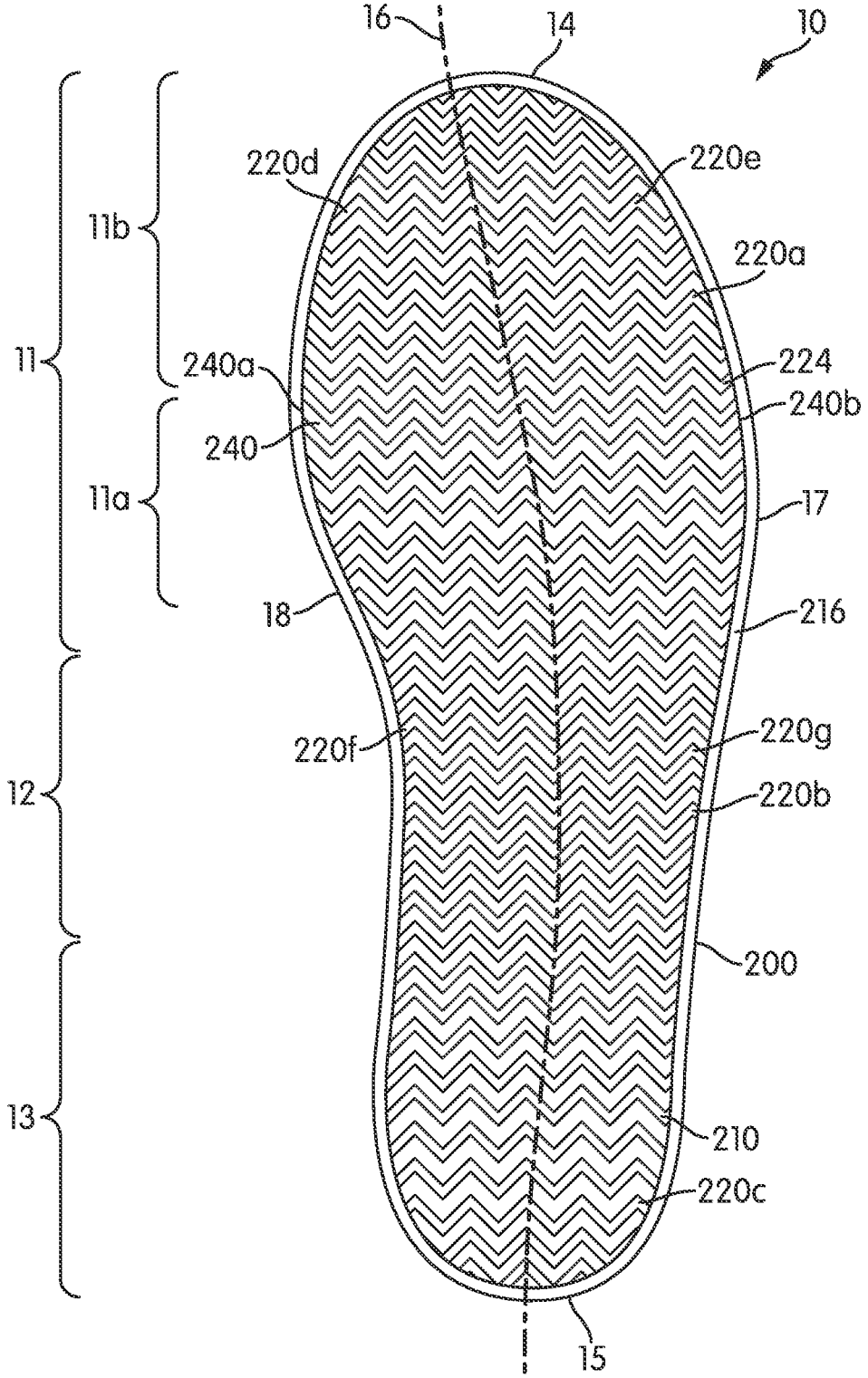
FIG. 1B is a bottom view of the article of footwear of FIG. 1A.

Referring to FIGS. 1A and 1B, an article of footwear 10 generally includes two primary components: an upper 100 and a sole structure 200. The upper 100 is secured to the sole structure 200 and forms a void on the interior of the footwear 10 for comfortably and securely receiving a foot. The sole structure 200 is secured to a lower portion of the upper 100 and is positioned between the foot and the ground. Upper 100 may include an ankle opening that provides the foot with access to the void within upper 100. As is conventional, upper 100 may also include a vamp area having a throat and a closure mechanism, such as laces.

Referring to FIG. 1B, typically, the sole structure 200 of the article of footwear 10 has a forefoot region 11, a midfoot region 12 and a heel region 13. Forefoot region 11 may further be considered to encompass a ball region 11*a* and a toe region 11*b*. Ball region 11*a* generally extends under the ball of the foot. Toe region 11*b* generally extends under the toes of the foot. Although regions 11-13 apply generally to sole structure 200, references to regions 11-13 may also apply to article of footwear 10, upper 100, or an individual component within either sole structure 200 or upper 100.

The sole structure 200 of the article of footwear 10 further has a toe or front edge 14 and a heel or back edge 15. A lateral edge 17 and a medial edge 18 each extend from the front edge 14 to the back edge 15. Further, the sole structure 200 of the article of footwear 10 defines a longitudinal centerline 16 extending from the back edge 15 to the front edge 14 and located generally midway between the lateral edge 17 and the medial edge 18. Longitudinal centerline 16 generally bisects sole structure 200, thereby defining a lateral side and a medial side.

Figure 1C:
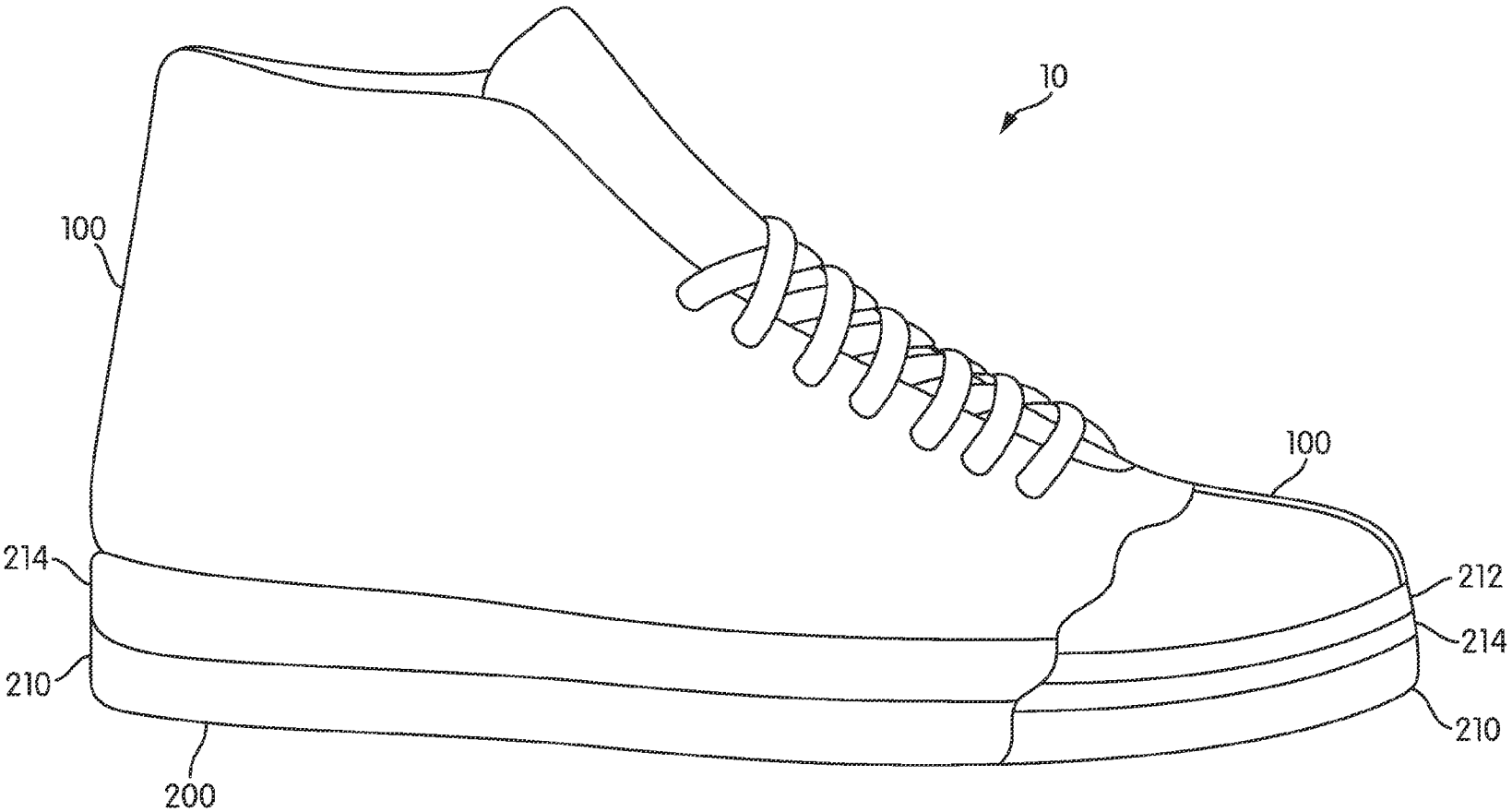
FIG. 1C is a schematic perspective view, looking from the lateral side, of an article of footwear, having a cut-away view in the forefoot region, in accordance with aspects of this disclosure.

Referring to FIG. 1C, according to some embodiments, a sole structure 200 may incorporate multiple layers, for example, an outsole structure 210 and an insole 212. The outsole structure 210 forms the ground-engaging portion (or other contact surface-engaging portion) of the sole structure 200, thereby providing traction and a feel for the engaged surface. The outsole structure 210 may also provide stability and localized support for the foot. Even further, the outsole structure 210 may provide impact-attenuation capabilities. Aspects of certain outsole structures will be discussed in detail below.

The insole 212 (or sockliner), is generally a thin, compressible member located within the void for receiving the foot and proximate to a lower surface of the foot. The insole 212, which is configured to enhance footwear comfort, may be formed of foam. For example, the insole 212 may be formed of a 5.0 mm thick layer of polyurethane foam, e.g., injected Phylon. Other materials such as ethylene vinyl acetate or other foamed rubber may be used to form an insole. Typically, the insole or sockliner 212 is not glued or otherwise attached to the other components of the sole structure 200, although it may be attached, if desired.

In addition to outsole structures 210 and insoles 212, certain sole structures may also include midsoles 214. Conventionally, midsoles 214 form a middle layer of the sole structure 200 and are positioned between the outsole structure 210 and the insole 212. The midsole 214 may be secured to the upper 100 along the lower length of the upper. Midsoles 214 may have impact-attenuation capabilities, thereby mitigating ground (or other contact surface) reaction forces and lessening stresses upon the foot and leg. Further, midsoles 214 may provide stability and/or additional localized support or motion control for the foot or portions of the foot.

According to certain aspects, a midsole 214 need not be provided. This may be particularly appropriate when the sole structure 200 is designed to have a low profile and/or to be lightweight.

The outsole structure 210 may have one or more regions or portions 220 defined. For example, as shown in FIG. 1B, the outsole structure 210 may include a forefoot portion 220*a*, a midfoot portion 220*b* and a heel portion 220*c*. Further, the outsole structure 210 may have a medial-side forefoot portion 220*d* and a lateral-side forefoot portion 220*e*. Additionally, the midfoot region may have a medial-side midfoot portion 220*f* and a lateral-side midfoot portion 220*g*. Heel portions may be similarly defined, as may toe portions. Further, portions associated with other regions of the foot, such as the ball of the foot, the arch, the great toe, etc., as would be known to persons of skill in the art, may also be used to define portions of the outsole structure 210.

Figure 2A:
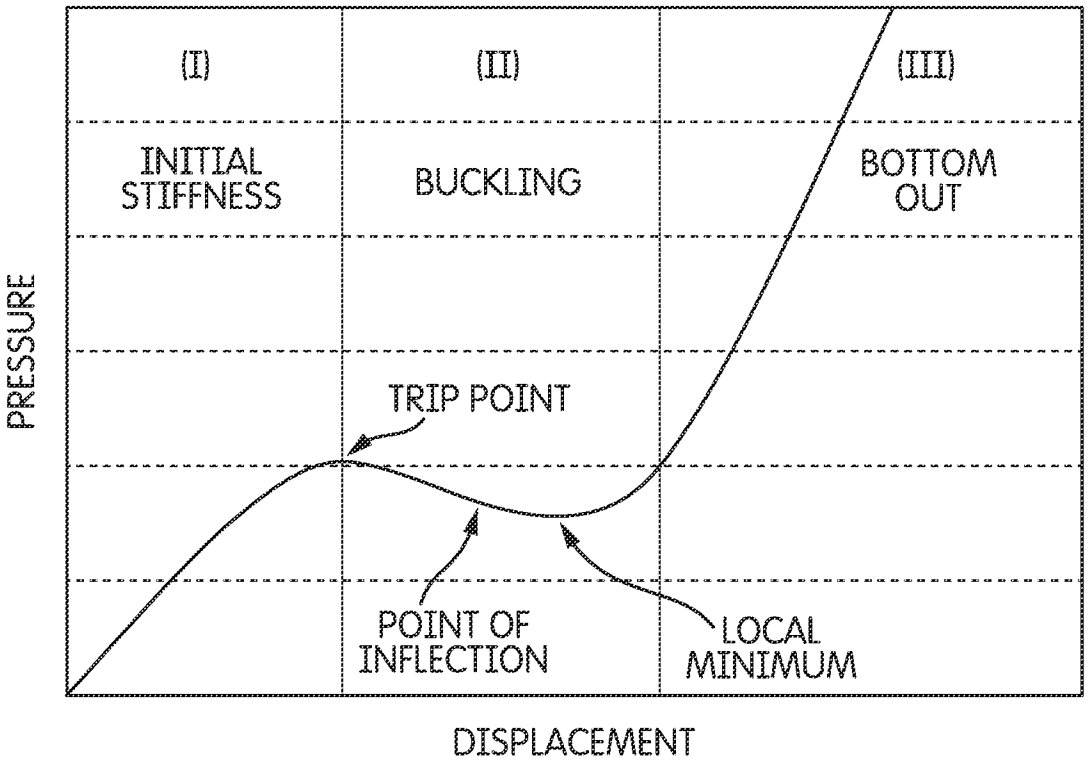
FIG. 2A is schematic of a representative "pressure versus displacement" curve of the type that may characterize outsole portions in accordance with aspects of this disclosure.
Figure 2B:
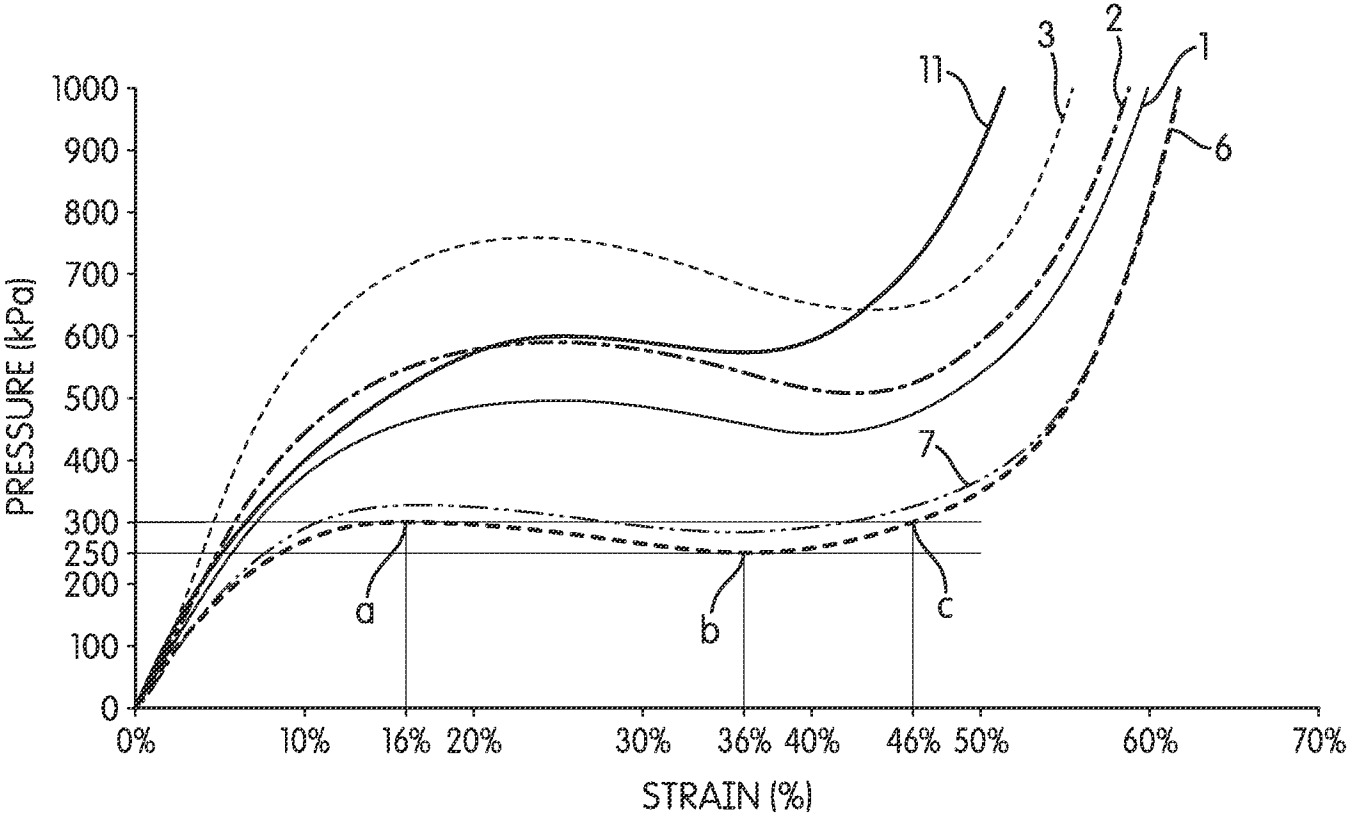
FIG. 2B is a set of experimentally measured "pressure versus strain" curves of certain exemplary embodiments of outsole portions in accordance with aspects of this disclosure.

According to some aspects of the present disclosure and referring to FIGS. 2A and 2B, at least some of the various outsole portions 220 have a pressure load versus displacement response system with multiple regimes, wherein each regime is associated with a displacement range and a stiffness characteristic. The stiffness characteristic of the outsole portion 220 may be described by the slope of a curve that relates the pressure response to the displacement. According to certain aspects, at lower loads, for example when walking or when a skateboard remains grounded, the outsole portion 220 reacts to pressure loads according to a first stiffness characteristic; and at higher loads, for example impact loads experienced when running or when landing after performing a big trick on the skateboard, the outsole structure 210 reacts to the pressure loads according to a second stiffness characteristic. Specifically, in some embodiments, the outsole portion 220 reacts to lower impact loads in a first, non-buckled, configuration and reacts to higher impact loads in a second, post-buckled, configuration. The first, non-buckled configuration may have an essentially linearly increasing load-versus-displacement curve. In the second, post-buckled configuration, the load-versus-displacement curve may have a negative slope and/or a substantially flat slope before the pressure load once again increases as a function of displacement. For purposes of this disclosure, "pressure" or a "pressure load" is measured as the applied load divided by the areal footprint of the loading fixture. Thus, a 100 Newton load applied with a 40 mm round tup results in an applied pressure load of 79.6 kPa (i.e., $100\ N/(\pi(20\ mm)^2)$). In other words, the pressure is determined using the overall gross area of the sole portion to which the load is applied, not just the specific net area of those elements of the sole portion that are directly contacted by the loading fixture.

Thus, according to aspects of the present disclosure, an outsole portion 220 may be designed with a particular structural configuration such that buckling occurs when the outsole structure is subjected to a predetermined pressure loading. For purposes of this disclosure, "buckling" refers to the occurrence of a relatively large deflection of a structure subjected to a compression load upon a relatively small increase in the compression load. The relatively large deflection in the direction of the application of the load may occur in conjunction with a large lateral deflection (i.e., a deflection lateral to the direction of the application of the load) of one or more components of the structure. For example, when a structure that consists of one or more relatively long, thin, slender members (e.g., plates or columns) is subjected to an initial compressive load, the long slender members may initially compress along their length in accordance with an essentially linear elastic stress-strain curve of the material. When this structure is then subjected to an increasing compressive load, at a certain critical load (referred to herein as a "trip point") the long slender members may deflect laterally (bowing out) such that the structure experiences a large displacement in the direction of load application with a small increase in applied load. This large lateral deflection changes the load-carrying configuration of the structure, in essence, changing the stiffness of the structure. In the buckled configuration, the load required to compress the structure is less than the load required to compress the structure the same amount in the initial configuration. Thus, for a given increase in load, relatively large compressive displacements occur in the buckled structure. In other words, in the buckled configuration, the structure is "softened" and impact loads may be attenuated. If the structure continues to compress under the load, at some point it will "bottom out," and once again, the compression will be governed by the stiffer stress/strain curve of the material.

A schematic example of a load versus displacement curve, as may be used to generally characterize such a multi-regime load versus displacement response system, is shown in FIG. 2A. This particular curve graphs "pressure" versus "displacement" for a generic outsole portion 220 in accordance with the present disclosure. In a first regime (I), an "initial stiffness" regime, the pressure versus displacement curve is characterized by a monotonically increasing response, i.e., as the displacement increases, the pressure required to effect that displacement increases. This initial stiffness regime is typically governed by the properties of the material(s) forming the outsole portion 220. At a "trip point" pressure, the system transitions to a second, "buckling" regime (II). In this buckling regime, it takes less force (or pressure) to compress the outsole structure 210 such that a cushioning effect is experienced. In other words, in the second regime (II), the pressure loading does not exceed the "trip point" pressure. This second regime is typically governed, not only by the material characteristics of the outsole portion 220, but also by the structural configuration of the outsole. Finally, in a third regime (III), a "bottomed out" regime, the pressure versus displacement curve may once again be characterized as being typically governed by the properties of the material (s) forming the outsole portion 220, rather than being governed by the particular structural configuration of the outsole portion 220.

Within the second regime (II) the pressure-versus-displacement curve of the outsole portions 220 may be described as being generally "S-shaped." This S-shape is due to the presence of the "trip point," which is a local maximum, a "point-of-inflection," and a local minimum. For purposes of the present disclosure, the term "point-of-inflection" refers to a point on a curve at which the change in curvature changes sign, i.e., when the curve changes from being concave downward to concave upward, or vice versa. In other words, the "point-of-inflection" is the point on a curve at which the second derivative changes sign. Even more simply, the point of inflection is where the tangent to the curve crosses the curve. At the local minimum, the pressure is at its minimum in the buckled regime. Further, relative to the first and third regimes, the change in the pressure carrying capacity of the outsole portions 220 in the second regime remains relatively flat.

According to certain aspects, the buckling of the outsole portion 220 is elastic buckling. For purposes of the present disclosure, the phrase "elastically-buckled" (and variations thereof) refers to a configuration of a load-carrying element wherein an abrupt and large increase in the displacement (usually accompanied by a relatively large lateral deflection) of the load-carrying element(s) occurs with only a minimal increase in the applied load, while the stresses acting on the load-carrying element remain wholly elastic. In such case, when the load is removed, the load-carrying element or elements assume their original configuration (i.e., the zero-load configuration) without experiencing any permanent deformation or set. In other words, elastic buckling has occurred if the buckled structure regains its original configuration upon the release of the buckling load. FIG. 2B illustrates mechanical test results as pressure-versus-strain curves for certain exemplary embodiments of the outsole portions 220. A 40 mm round tup was used to compress the sample outsole portions 220 (using a 3 Hz haversine waveform and a compression of 4 mm). Thus, for purposes of the present disclosure, the vertical pressure-carrying capacity of the outsole portions 220 is measured over a circular area having a 40 mm diameter. The geometry for the tested samples is presented in Table I, below. The tested outsole portion samples listed in Table I were made of a solid rubber having a typical Shore A hardness of between 74-80. In general, the outsole portions are not limited to being made of a solid rubber having a Shore A hardness of 74-80, but may be made of any suitable material, including conventional outsole rubbers as known and used by persons of ordinary skill in the art.

In FIG. 2B, several pressure-versus-strain curves for various outsole portions are presented. The pressure-versus-strain curves have a local maximum pressure at a "trip point" pressure value and a first strain value. Further, the pressure-versus-strain curves have a local minimum pressure value at a second strain value. The second strain value is greater than the first strain value. Even further, these pressure-versus-strain curves have a second occurrence of the "trip point" pressure value at a third strain value, which is greater than the second strain value. The change in the strain between the first occurrence of the "trip point" pressure value and the second occurrence of the "trip point" pressure value may be at least 10%, and more typically may be greater than 20%. The pressure-carrying capacity of the outsole portion between the first and second occurrences of the "trip point" pressure value may vary by less than or equal to approximately 20%. For example, in FIG. 2B, the outsole portion 220 associated with curve 6 (sample 6 of Table I) has a "trip point" pressure value (see point "a") of approximately 300 kPa at a strain of approximately 16%. At a strain of approximately 46%, the pressure-carrying capacity of the outsole portion associated with curve 6 again reaches the "trip point" pressure value of approximately 300 kPa. This second occurrence of the "trip point" pressure value occurs at point "c". Between the strains of 16% and 46%, a local minimum pressure carrying capacity of the outsole portion associated with curve 6 is approximately 250 kPa at a strain of approximately 36% (see point "b"). Thus, the outsole portion 220 associated with curve 6 has a "trip point" pressure value of approximately 300 kPa, a second regime that extends over a strain range of approximately 30% (i.e., the change in the strain between the first occurrence of the "trip point" pressure value and the second occurrence of the "trip point" pressure value is 46% minus 16%), and a change in pressure-carrying capacity over the extent of the second regime of approximately 50 kPa (i.e., 300 kPa minus 250 kPa). In other words, the pressure-carrying capacity of the outsole portion 220 associated with curve 6 changed by only approximately 17% (i.e., 50 kPa divided by 300 kPa) over a strain range of approximately 30%.

In FIG. 2B, the outsole portion 220 associated with curve 7 (sample 7 of Table I) has a "trip point" pressure value of approximately 350 kPa at a strain of approximately 17%. At a strain of approximately 48%, the pressure-carrying capacity of the outsole portion associated with curve 7 again reaches the "trip point" value of approximately 350 kPa. Between the strains of 17% and 48%, the minimum pressure carrying capacity of the outsole portion associated with curve 7 is approximately 280 kPa at a strain of approximately 35%. Thus, the outsole portion 220 associated with curve 7 has a "trip point" pressure value of approximately 350 kPa, a second regime that extends over a strain range of approximately 31% (i.e., 48% minus 17%), and a change in pressure-carrying capacity over the extent of the second regime of approximately 70 kPa (i.e., 350 kPa minus 280 kPa). In other words, the pressure-carrying capacity of the outsole portion 220 associated with curve 7 changed by only approximately 20% (i.e., 70 kPa divided by 350 kPa) over a strain range of approximately 31%.

Looking at another curve in FIG. 2B in detail, it is seen that the outsole portion 220 associated with curve 1 (sample 1 of Table I) has a "trip point" pressure value of approximately 500 kPa at a strain of approximately 23%. At a strain of approximately 47%, the pressure-carrying capacity of the outsole portion associated with curve 1 again reaches the "trip point" value of approximately 500 kPa. Between the strains of 23% and 47%, the minimum pressure carrying capacity of the outsole portion associated with curve 1 is approximately 420 kPa at a strain of approximately 41%. Thus, the outsole portion 220 associated with curve 1 has a "trip point" pressure value of approximately 500 kPa, a second regime that extends over a strain range of approximately 24% (i.e., 47% minus 23%), and a change in pressure-carrying capacity over the extent of the second regime of approximately 80 kPa (i.e., 500 kPa minus 420 kPa). In other words, the pressure-carrying capacity of the outsole portion 220 associated with curve 1 changed by only approximately 16% (i.e., 80 kPa divided by 500 kPa) over a strain range of approximately 24%.

In FIG. 2B, the outsole portion 220 associated with curve 11 (sample 11 of Table I) has a "trip point" pressure value of approximately 590 kPa at a strain of approximately 27%. At a strain of approximately 42%, the pressure-carrying capacity of the outsole portion associated with curve 11 again reaches the "trip point" value of approximately 590 kPa. Between the strains of 27% and 42%, the minimum pressure carrying capacity of the outsole portion associated with curve 11 is approximately 560 kPa at a strain of approximately 37%. Thus, the outsole portion 220 associated with curve 11 has a "trip point" pressure value of approximately 590 kPa, a second regime that extends over a strain range of approximately 15% (i.e., 42% minus 27%), and a change in pressure-carrying capacity over the extent of the second regime of approximately 30 kPa (i.e., 590 kPa minus 560 kPa). In other words, the pressure-carrying capacity of the outsole portion 220 associated with curve 11 changed by only approximately 5% (i.e., 30 kPa divided by 590 kPa) over a strain range of approximately 15%.

In general, the curves of FIG. 2B illustrate that the outsole portions 220 have pressure-versus-strain curves exhibiting a local maximum pressure (i.e., the "trip point" pressure value) at a first strain value and a change in strain of at least approximately 10% before the "trip point" pressure value is reached again. For certain embodiments, it can be seen that the change in strain between the first and second occurrences of the "trip point" pressure value may be at least approximately 15%, 20%, 25%, 30% or even greater than approximately 30%. Further, it can be seen that the curves of FIG. 2B illustrate that the outsole portions 220 have pressure-versus-strain curves exhibiting a local minimum pressure between the first and second occurrences of the "trip point" pressure value. This local minimum pressure may be between approximately 60% to 100% of the "trip point" value. For certain embodiments, the local minimum pressure may be greater than approximately 70%, greater than approximately 80% or even greater than approximately 90% of the "trip point" pressure value. In other words, it can be seen that the change in pressure between the first and second occurrences of the "trip point" pressure value may be less than approximately 40%, 30%, 25%, 20%, 15%, 10% or even less than or equal to approximately 5%. Additionally, between the first and second occurrences of the "trip point" pressure value the change in strain may be greater than or equal to approximately 10%, 15%, 20%, 25% or 30%.

Figure 3A:
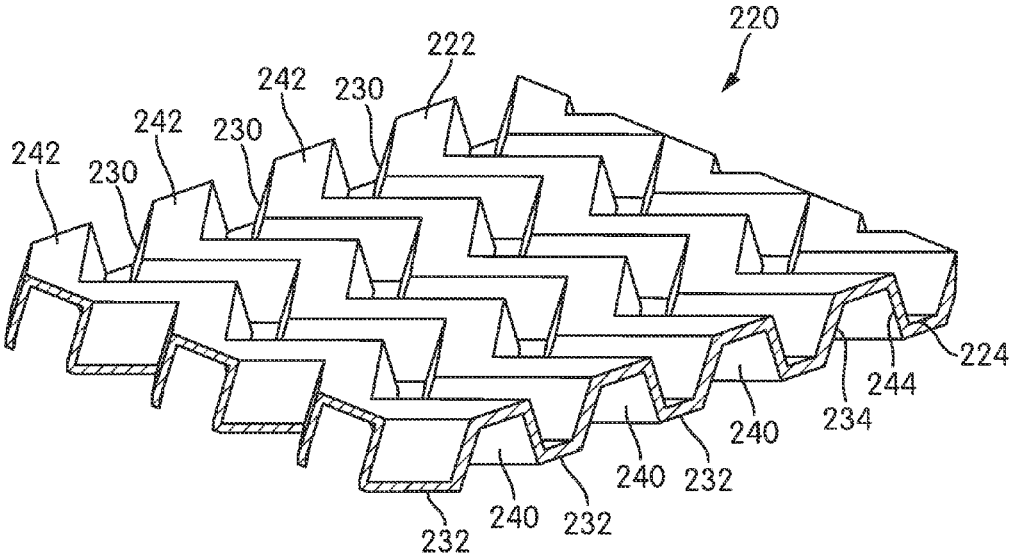
FIG. 3A is a perspective, cut-away, view of an embodiment of an outsole portion in an unloaded configuration in accordance with aspects of this disclosure.
Figure 3B:
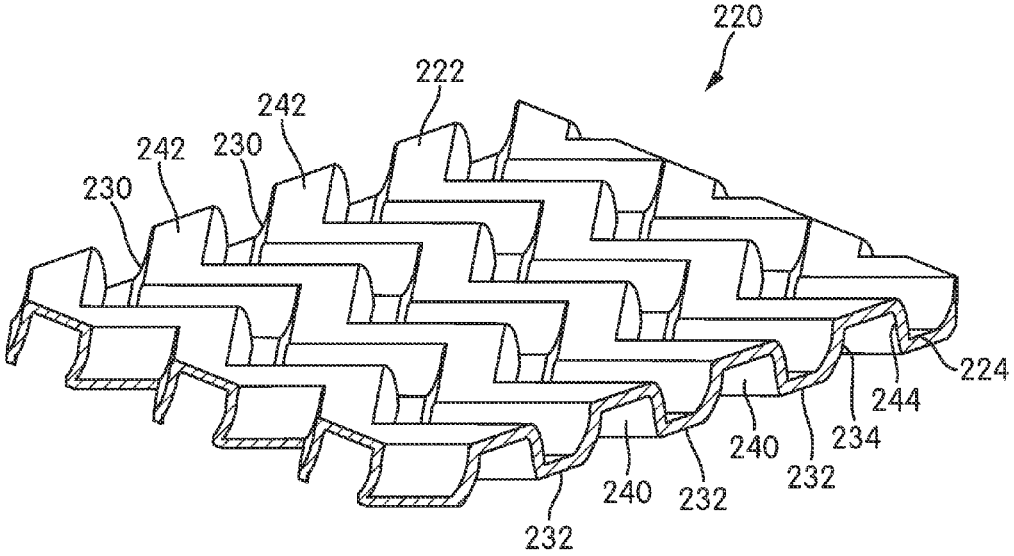
FIG. 3B is a perspective, cut-away, view of an embodiment of an outsole portion in a buckled configuration in accordance with aspects of this disclosure.
Figure 4:
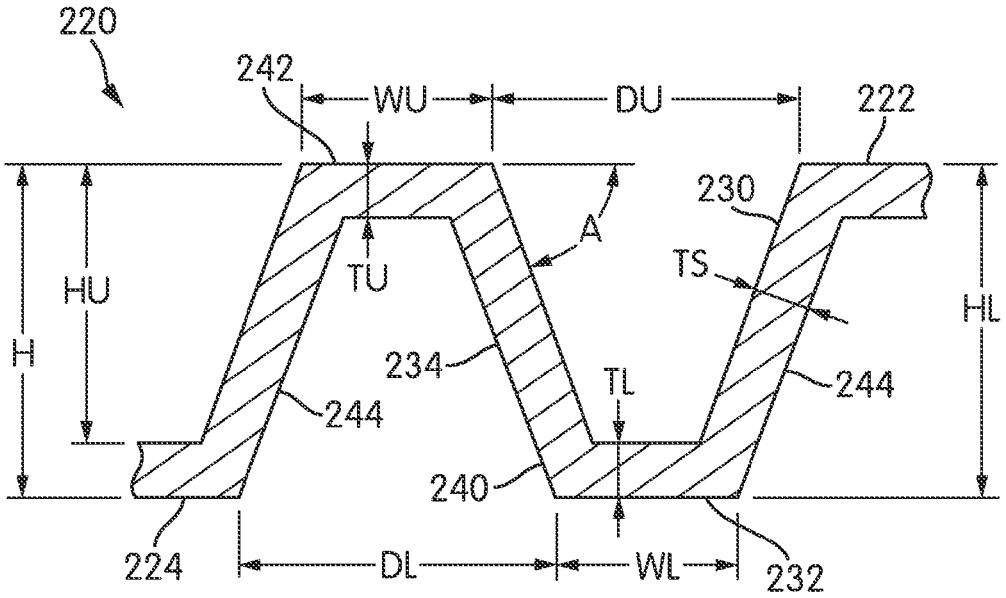
FIG. 4 is a schematic cross-section, viewed down the elongate axis of a channel, of a section of a representative outsole portion in accordance with aspects of this disclosure.

According to aspects of the disclosure and referring now to FIGS. 3A, 3B and 4, at least one or more regions or outsole portions 220 of the outsole structure 210 has a zig-zagged channel configuration. The channels 230, 240 extend between an upper or top layer 222 and a lower or bottom layer 224, wherein the bottom layer 224 is vertically displaced from the top layer 222. The top layer 222 is provided to support the foot and is located in the interior of the footwear. The top layer 222, as a whole, may be considered to be essentially planar, with only slight curvatures or out-of-plane geometries as would be in keeping with an outsole structure 210 following the contours of a foot. The bottom layer 224 is provided to contact the ground (the term "ground" as used herein encompasses any type of contact surface). According to certain embodiments the bottom layer 224 of the outsole structure 210 as a whole may be considered to be essentially planar, with only slight curvatures or out-of-plane geometries. In certain other embodiments, select portions of the bottom layer of the outsole structure 210 (for example, the bottom layer 224 in the midfoot portion 220*b*) may depart from the plane of the remainder of the bottom layer.

Thus, the outsole structure 210 may include one or more outsole portions 220 and one or more of these outsole portions 220 may have a multi-regime pressure load versus displacement response system as discussed above.

Referring again to FIGS. 3A, 3B and 4 and according to certain aspects of the disclosure, a multi-regime outsole portion 220 includes a plurality of alternating upward-facing elongate channels 230 and downward-facing elongate channels 240. FIG. 3A is a perspective, cut-away, view of an embodiment of an outsole portion 220 in its undeformed, unloaded configuration; FIG. 3B is a perspective, cut-away, view of an embodiment of an outsole portion 220 in a buckled configuration. FIG. 4 is a cross-section, viewed down the elongate axis of channels 230 and 240, of a section of an outsole portion 220. As best shown in FIG. 4, each channel 230, 240 has a base element 232, 242 and two sidewalls 234, 244, with adjacent upward-facing and downward-facing channels 230, 240 sharing common sidewalls. The base elements 232, 242 and the sidewalls 234, 244 extend along the elongated lengths of the channels 230, 240. The plurality of base elements 242 of the downward-facing channels 240, in the aggregate, forms the top layer 222 of the outsole portion 220. In other words, the top layer 222 is not continuous, but is formed of discrete base elements 242 that in the aggregate form a platform for a foot to (directly or indirectly) stand on. Because the base element 242 of each downward-facing channel 240 is generally independent of and discrete from the base elements 242 of the adjacent downward-facing channels 240, the top layer 222 is formed as a series or an array of, at least substantially, discrete base elements 242. Similarly, the plurality of base elements 232 of the upward-facing channels 230, in the aggregate, forms the bottom layer 224 of the outsole portion 220. Because, in general, the base element 232 of each upward-facing channel 230 is independent of and discrete from the base elements 232 of the adjacent upward-facing channels 230, the bottom layer 224 is formed as a series or an array of, at least substantially, discrete base elements 232. These base elements 232 may move relative to one another in a quasi-independent manner. In some constructions, the independent and discrete base elements 232, 242 may be connected together over some portions of their structure, e.g., along the perimeter edges of the outsole structure 210, through an interconnecting ridge or rib structure, etc.

The elongate sidewall elements 234, 244 are plate-like elements that extend from the elongate base elements 242 of the top layer 222 to the elongate base elements 232 of the bottom layer 224, thereby forming the alternating upward-facing and downward-facing channels 230, 240. Specifically, each of the sidewall elements 234, 244 extends from an elongated edge of one of the base elements 242 of the top layer 222 to an elongated edge of one of the base elements 232 of the bottom layer 224. At least one of the sidewalls 234, 244 of each channel 230, 240 is arranged at an angle to the top layer 222 of the outsole portion 220 that is greater than 45 degrees. More typically the sidewalls 234, 244 may extend at an angle of 70 degrees or greater from the surface plane of the top layer 222.

Thus, according to aspects of the disclosure, the outsole portion 220 has a top layer 222 a bottom layer 224, and a plurality of sidewalls 234, 244 extending therebetween, wherein the top layer 222, the bottom layer 224 and the sidewalls 234, 244 are configured to provide an array of alternating upward-facing channels 230 (upper channels) and downward-facing channels 240 (lower channels). In the embodiment of FIG. 4, as viewed down the elongated length of the channels 230, 240 (i.e., in a vertical plane perpendicular to the sidewalls 234, 244 of the channels), each of the upper and lower channels 230, 240 is a C-channel having outwardly angled sidewalls 234, 244, i.e., sidewalls that form an angle (A) with the upper base elements 242. When the angled sidewalls 234, 244 diverge from one another as shown in FIG. 4 (i.e., the angle (A) is an acute angle), this "splayed" C-channel may also be referred to as a "hat section." Further, in this example embodiment, the thickness (TU) of the upper base elements 242 (and, thereby, also of the top or upper layer 222 of the outsole portion 220), the thickness (TL) of the lower base elements 232 (and, thereby, also of the bottom or lower layer 224 of the outsole portion 220), and the thickness (TS) of the sidewalls 234, 244 are constant. Even further, in this particular example embodiment, the width (WU) of the upper, elongated, base element 242 is the same as the width (WL) of the lower, elongated, base element 232. Additionally, in this particular example embodiment, the height (H) of the outsole portion 220 does not vary and the heights (HU, HL) of the upper and lower channels 230, 240 are equal to one another and remain constant for the entire array of channels. Finally, in the embodiment of FIG. 4, the upper channel 230, if rotated 180 degrees around a horizontal axis, is identical to the lower channel 240.

The particular dimensions of the outsole portion 220 and of the channels 230, 240 may depend upon the particular application for the article of footwear 10. Further, the dimensions of the outsole portion 220 and of the channels 230, 240 may depend upon the degree of impact-attenuation desired, the degree of flexibility desired, the locations of the channels 230, 240 under the foot, the existence and/or spacing of adjacent channels 230, 240, the material used to form the channels 230, 240, the user's "feel" preferences, etc.

For example, still referring to FIG. 4, the height (H) of the outsole portion 220 may vary depending upon its location in the outsole structure 210. Thus, the height (H) of the outsole portion 220 in the heel portion 220*c* may be greater than the height (H) in the forefoot portion 220*a*. In general the height (H) of the outsole portion 220 may range from approximately 4.0 mm to approximately 18.0 mm. For certain embodiments, the height (H) of an outsole portion may be less than or equal to approximately 10.0 mm. For example, the height (H) of the outsole portion may range from approximately 4.0 mm to approximately 10.0 mm (e.g., as may be most appropriate in a forefoot portion 220*a*). By way of other non-limiting examples, the height (H) of an outsole portion 220 may range from approximately 5.0 mm to approximately 9.0 mm or even from approximately 6.0 mm to approximately 8.0 mm. Optionally, for other embodiments, the height (H) of an outsole portion 220 may be greater than or equal to approximately 10.0 mm. For example, the height (H) of the outsole portion may range from approximately 10.0 mm to approximately 18.0 mm (as may be most appropriate in a heel portion 220*c* or, for example, for a basketball shoe). Thus, for example, the height (H) of an outsole portion 220 may range from approximately 10.0 mm to approximately 16.0 mm or even from approximately 11.0 mm to approximately 14.0 mm. For even other alternative embodiments, the height (H) of an outsole portion 220 may range from approximately 6.0 mm to approximately 17.0 mm, from approximately 6.0 mm to approximately 12.0 mm, from approximately 9.0 mm to approximately 16.0 mm, or even from approximately 10.0 mm to approximately 15.0 mm depending upon the expected loading conditions and the desired stiffness characteristics. The height (H) of any one channel 230, 240 may vary along the length of the channel 230, 240. Further, undulations in the height (H) of the channels 230, 240 along the lengths of the channels 230, 240 (e.g., vertical undulations) may assist the shoe designer in tailoring the traction area for specific applications.

According to other aspects, the thickness (TU, TL) of the base elements 232, 242 and the thickness (TS) of the sidewalls 234, 244 of the channels 230, 240 may depend upon the desired performance of the outsole portion 220. Thus, in certain embodiments, for example as shown in FIG. 4, the thicknesses of the base elements 232, 242 and/or of the sidewalls 234, 244 may be the same, and further, these thicknesses may be constant along the elongated length of the channels 230, 240 and/or along the heights (HU, HL) of the channels 230, 240. For example, the thickness (TU, TL) of the base elements 232, 242 may range from approximately 0.5 mm to approximately 3.5 mm. In order to minimize the weight of the outsole portions 220, the thicknesses (TU, TL) of the base elements 242, 232 may range from approximately 0.5 mm to approximately 1.5 mm or even from approximately 0.8 mm to approximately 1.3 mm. In order to increase the durability of the outsole portions 220, the thicknesses (TU, TL) of the base elements 242, 232 may range from approximately 1.0 mm to approximately 3.5 mm or even from approximately 1.2 mm to approximately 2.5 mm. In some embodiments, the thickness (TU, TL) of the base elements 242, 232 may depend upon their location in the outsole structure 210. Thus, the thickness (TU, TL) of the base elements 242, 232 in the heel portion 220*c* may be greater than the thickness (TU, TL) of the base elements 242, 232 in the forefoot portion 220*a*. In certain other embodiments, the thickness (TU, TL) of the base elements 242, 232 in certain medial portions (e.g., 220*d*, 220*f*, etc.) may be greater than the thickness (TU, TL) of the base elements 242, 232 in certain lateral portions (e.g., 220*e*, 220*g*, etc.).

Figure 5A:
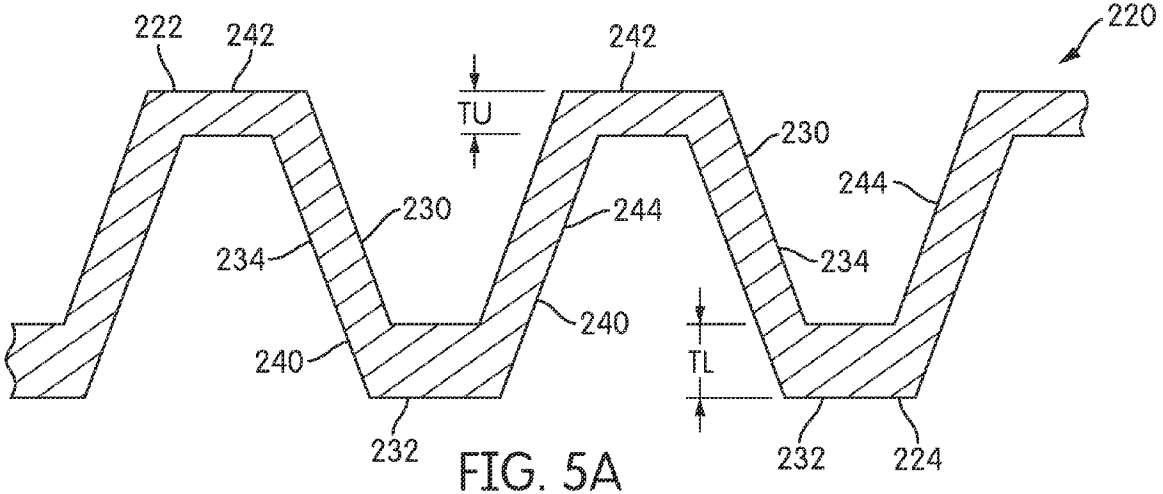
FIGS. 5A through 5G are schematic cross sections, viewed down the elongate axis of a channel, of a section of representative outsole portions illustrating certain aspects of the outsole portions in accordance with aspects of this disclosure.
Figure 5B:
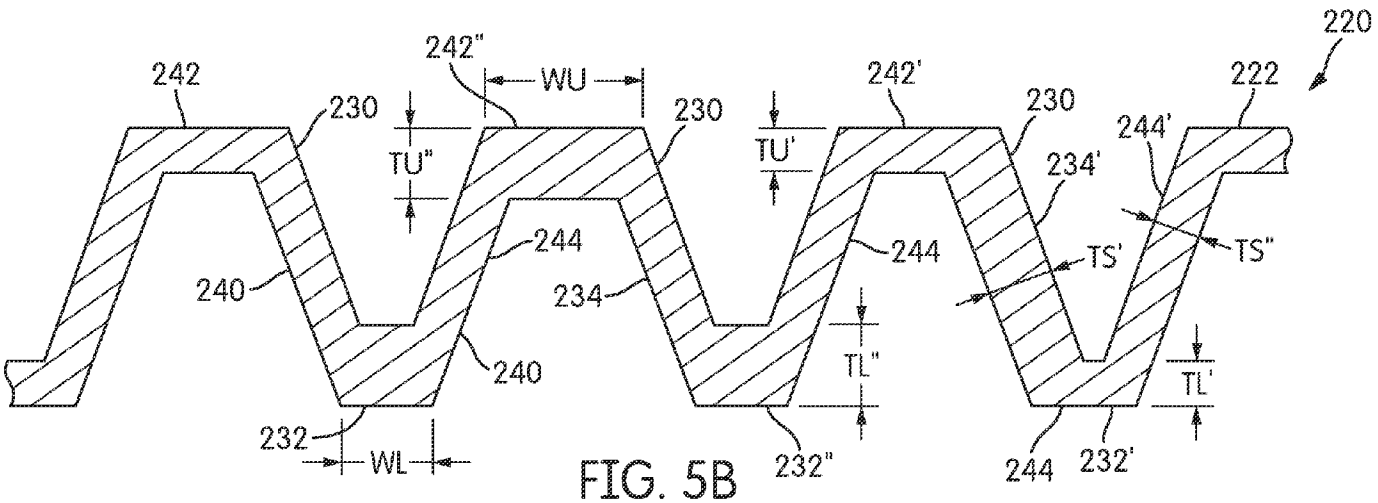

Additionally, referring for example to FIG. 5A, the thicknesses (TU) of the upper base elements 242 need not be the same as the thicknesses (TL) of the lower base elements 232. For example, the thickness TU may be less than the thickness TL. Referring to FIG. 5B, in certain embodiments, the thicknesses TU', TU" of adjacent upper base elements 242', 242" need not be the same. For example, the thickness TU' may be less than the thickness TU". Similarly, the thicknesses TL', TL" of adjacent lower base elements 232', 232" need not be the same.

Figure 5C:
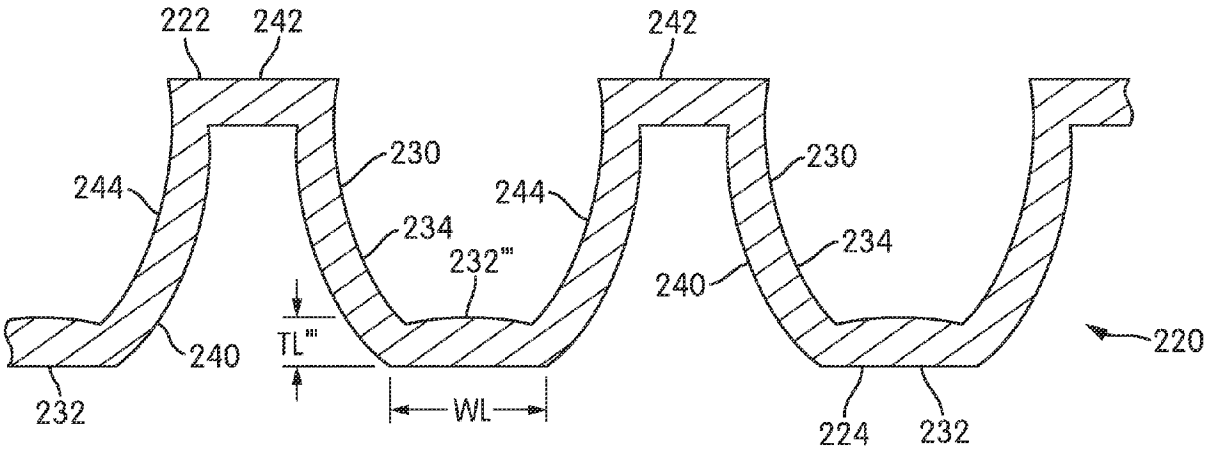

According to other aspects, the thickness (TU, TL) of any individual base element 242, 232 need not be constant. For example as shown in FIG. 5C, the thickness TL' of base element 232" may vary as the base element 232'" extends from one sidewall 234 to the other sidewall 244 (i.e., across the width (WL) of the base element 232'). In this illustrated example, the thickness TL'" of the base element 232' increases and then decreases along its width WL. Optionally, the thickness (TU, TL) of the base elements 242, 232 may vary along the elongate axis (i.e., along the length) of the channel 230, 240.

According to even other aspects, and referring back to FIG. 4, the thickness (TS) of the sidewalls 234, 244 may range from approximately 0.5 mm to approximately 2.0 mm. In order to minimize the weight of the outsole portions 220, especially where impact loads are expected to be relatively low, the thickness (TS) of the sidewalls 234, 244 may range from approximately 0.5 mm to approximately 1.5 mm or even from approximately 0.8 mm to approximately 1.3 mm. Where impact loads are expected to be relatively high, the thickness (TS) of the sidewalls 234, 244 may range from approximately 1.0 mm to approximately 2.0 mm or even from approximately 1.2 mm to approximately 1.8 mm. In some embodiments, the thickness (TS) of the sidewalls 234, 244 may depend upon their location in the outsole structure 210. Thus, the thickness (TS) of the sidewalls 234, 244 in the heel portion 220*c* may be greater than the thickness (TS) of the sidewalls 234, 244 in the forefoot portion 220*a*. In certain other embodiments, the thicknesses (TS) of the sidewalls 234, 244 in certain medial portions (e.g., 220*d*, 220*f*, etc.) may be greater than the thicknesses (TS) of the sidewalls 234, 244 in certain lateral portions (e.g., 220*e*, 220*g*, etc.) in the outsole structure 210.

In even other embodiments, referring to FIG. 5B, the thicknesses ((TS', TS") of adjacent sidewalls 234, 244 need not be the same. In this illustrated example, the thickness TS' of a sidewall 234' is greater than the thickness TS" of an adjacent sidewall 244'. Optionally, as best shown in FIG. 5C, the sidewalls 234, 244 need not be flat or planar, but may curve or bulge. For example, adjacent sidewalls 234, 244 may curve in opposite directions as shown in FIG. 5C, or they may curve in the same direction. Further, the thickness (TS) of any individual sidewall 234, 244 need not be constant. For example, referring to FIG. 5D, the thicknesses TS' of sidewalls 234'" and 244'" increase as the sidewalls 234' and 244' extend from the top layer 222 to the bottom layer 224. As another optional embodiment, the thicknesses (TS) of the sidewalls 234, 244 may vary along the elongate axes of the channels 230, 240.

According to even additional aspects and referring back to FIG. 4, the width (WU, WL) of the base elements 242, 232 of the upper and lower channels 230, 240 may be selected to provide particular performance characteristics of the outsole portion 220, such as weight, stiffness, mounting area and traction area. Thus, in this particular illustrated embodiment, the width (WU) of the upper base elements 242 may be the same as the width (WL) of the lower base elements 232. The width (WU, WL) of the base elements 242, 232 may range from approximately 1.0 mm to approximately 5.0 mm. In order to minimize the weight of the outsole portion 220, the widths (WU) of the upper base elements 242 may range from approximately 2.0 mm to approximately 5.0 mm or, more limited, from approximately 2.5 mm to approximately 3.5 mm. Similarly, the widths (WL) of the lower base elements 232 may also range from approximately 2.0 mm to approximately 5.0 mm, or more limited, from approximately 2.5 mm to approximately 3.5 mm. Having a relatively wide width (WU, WL) for the base elements 242, 232 spaces the sidewalls 234, 244 of the channels 230, 240 further apart, such that the mass of the outsole portion 220 may be minimized. On the other hand, in order to increase the stiffness of the outsole structure 210, the base elements 242, 232 may be provided with relatively narrow widths (WU, WL), such that the sidewalls 234, 244 are more closely spaced. Thus, for certain embodiments, the widths (WU, WL) of the upper and/or lower base elements 242, 232 may range from approximately 1.0 mm to approximately 2.0 mm or, even more limited, from approximately 1.0 mm to approximately 1.5 mm.

In some embodiments, the width (WU, WL) of the base elements 242, 232 may depend upon their location in the outsole portion 220. Thus, the width (WU, WL) of the base elements 242, 232 in the heel portion 220*c* may be less than the width (WU, WL) of the base elements 242, 232 in the forefoot portion 220*a*. In certain other embodiments, the width (WU, WL) of the base elements 242, 232 in certain medial portions 220*d*, 220*f*, etc. may be greater than the width (WU, WL) of the base elements 242, 232 in certain lateral portions 220*e*, 220*g*, etc.

Figure 5D:
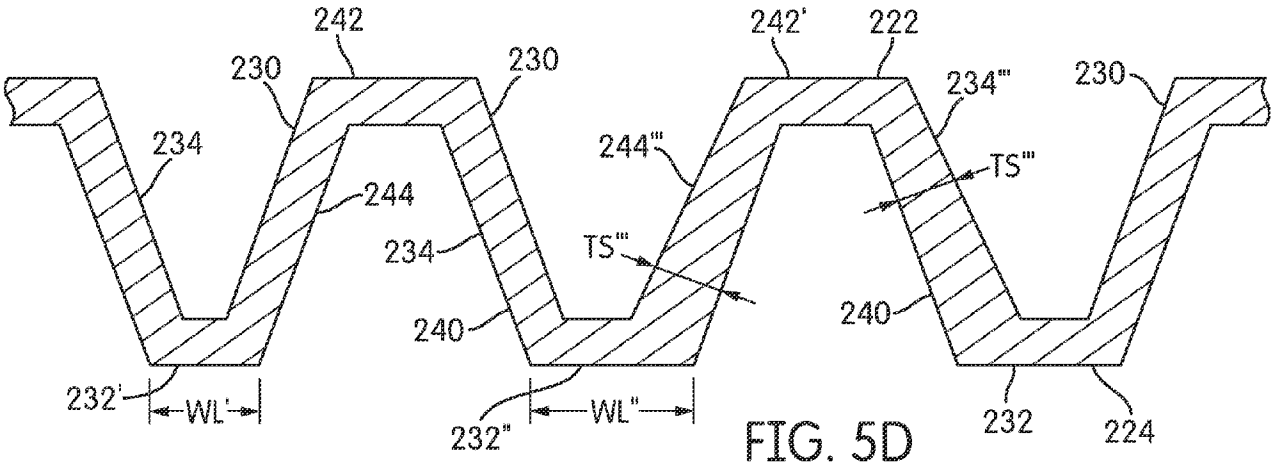

In certain embodiments, for example referring to FIG. 5D, the width (WL, WU) of adjacent upper or lower base elements 232, 242 need not be the same. As shown, the width WL' of a first base element 232' is less than the width WL" of an adjacent base element 232". Further, the width (WU, WL) of any individual base element 242, 232 need not be constant. For example, the width (WU, WL) of a base element 242, 232 may vary along the elongate axis of the elongate channel 230, 240.

Figure 5E:
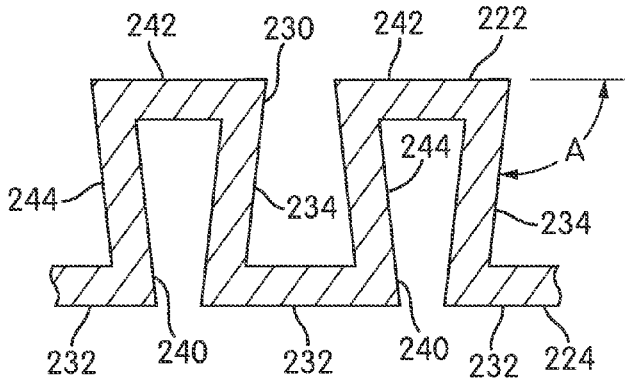

Another parameter shown in FIG. 4 that affects the performance of the outsole portion 220 is the angle (A) that the sidewall elements 234, 244 make to the top layer 222. Thus, according to certain aspects, the angle (A) of the sidewall elements 234, 244 from the upper base elements 242 may range from approximately 50 degrees to approximately 130 degrees. If the sidewall angle (A) is from 50 degrees to just less than 90 degrees from the base elements 242, the channel 240 may be considered to have a "splayed" configuration. At 90 degrees the sidewalls 234, 244 are vertical and the cross-section of the channels 230, 240 forms a square wave. At greater than 90 degrees, for example as shown in FIG. 5E, the sidewalls 234, 244 of each channel 230, 240 converge toward each other in what might be referred to as a "knock-kneed" configuration. To a certain extent it is expected that the more vertical are the sidewalls 234, 244, the greater may be the "trip point." Thus, for channels 230, 240 having a "splayed" section (see FIG. 4), the angle (A) of the sidewalls 234, 244 may range from approximately 50 degrees to less than 90 degrees or, more limited, from approximately 65 degrees to approximately 85 degrees. According to certain embodiments, the angle (A) of the sidewalls 234, 244 may be greater than approximately 70 degrees. For channels 230, 240 having a "knock-kneed" section (see FIG. 5E), the angle (A) of the sidewalls 234, 244 may range from greater than 90 degrees to approximately 130 degrees or, more limited, from approximately 115 degrees to approximately 95 degrees. According to certain embodiments, the angle (A) of the sidewalls 234, 244 may be less than approximately 110 degrees. In some embodiments, the angles (A) of the sidewalls 234, 234 need not be the same for both sidewalls, such that the cross-section of the channel 230, 240 would be non-symmetric.

Representative geometries for select outsole portions are presented in Table I (with reference to FIG. 4). The embodiments having heights of 6.0 mm may be most suitable for use in the forefoot portions 220*a* of the outsole structure 210. The embodiments having heights of 10.0 mm may be most suitable for use in the heel portions 220*c* of the outsole structure 210. The embodiments having a thicker lower base element provide additional tread thickness for enhanced durability. These embodiments, with heights of 7.5 mm, may be suitable for use in the forefoot portion 220*a* and/or the heel portion 220*c*. It is to be understood that depending upon the specific application and the expected impact loads, these and other geometries, as would be apparent to persons of skill in the art given the benefit of this disclosure, could be used in any portion of the outsole structure.

TABLE I

Representative Geometries for Certain Embodiments

| Example | Angle (A) (deg) | Sidewall Thickness (TS) (mm) | Upper Base Element Thickness (TU) (mm) | Upper Base Element Width (WU) (mm) | Lower Base Element Thickness (TL) (mm) | Lower Base Element Width (WL) (mm) | Height (H) (mm) |
|---|---|---|---|---|---|---|---|
| 1 | 70 | 1.0 | 1.0 | 3.0 | 1.0 | 3.0 | 6.0 |
| 2 | 74 | 1.0 | 1.0 | 3.0 | 1.0 | 3.0 | 6.0 |
| 3 | 82 | 1.0 | 1.0 | 3.0 | 1.0 | 3.0 | 6.0 |
| 4 | 83 | 1.0 | 1.0 | 3.0 | 1.0 | 3.0 | 6.0 |
| 5 | 85 | 1.0 | 1.0 | 3.0 | 1.0 | 3.0 | 6.0 |
| 6 | 70 | 1.0 | 1.0 | 3.0 | 1.0 | 1.25 | 6.0 |
| 7 | 71 | 1.0 | 1.0 | 3.0 | 1.0 | 1.25 | 6.0 |
| 8 | 78 | 1.0 | 1.0 | 3.0 | 1.0 | 1.25 | 6.0 |
| 9 | 70 | 1.1 | 1.1 | 3.0 | 1.1 | 3.0 | 6.0 |
| 10 | 70 | 1.25 | 1.0 | 3.0 | 1.0 | 1.25 | 6.0 |
| 11 | 70 | 1.25 | 1.25 | 3.0 | 1.25 | 1.25 | 6.0 |
| 12 | 70 | 1.25 | 1.25 | 3.0 | 1.25 | 3.0 | 6.0 |
| 13 | 70 | 1.0 | 1.0 | 3.0 | 2.5 | 1.25 | 7.5 |
| 14 | 70 | 1.5 | 1.5 | 3.0 | 2.5 | 1.25 | 7.5 |
| 15 | 70 | 1.0 | 1.0 | 3.0 | 1.0 | 3.0 | 10.0 |
| 16 | 70 | 1.5 | 1.5 | 3.0 | 1.5 | 3.0 | 10.0 |
| 17 | 85 | 1.0 | 1.0 | 3.0 | 1.0 | 3.0 | 10.0 |
| 18 | 85 | 1.5 | 1.5 | 3.0 | 1.5 | 3.0 | 10.0 |
| 19 | 73 | 1.0 | 1.0 | 3.0 | 1.0 | 3.0 | 6.0 |
| 20 | 70 | 1.2 | 1.2 | 3.0 | 1.2 | 3.0 | 6.0 |

TABLE I-continued

Representative Geometries for Certain Embodiments

| Example | Angle (A) (deg) | Sidewall Thickness (TS) (mm) | Upper Base Element Thickness (TU) (mm) | Upper Base Element Width (WU) (mm) | Lower Base Element Thickness (TL) (mm) | Lower Base Element Width (WL) (mm) | Height (H) (mm) |
|---|---|---|---|---|---|---|---|
| 21 | 70 | 1.5 | 1.5 | 3.8 | 2.7 | 1.25 | 6.0 |
| 22 | 70 | 1.5 | 1.5 | 6.8 | 2.7 | 1.25 | 6.0 |
| 23 | 70 | 1.5 | 2.2 | 1.6 | 2.7 | 1.25 | 9.0 |

Figure 6A:
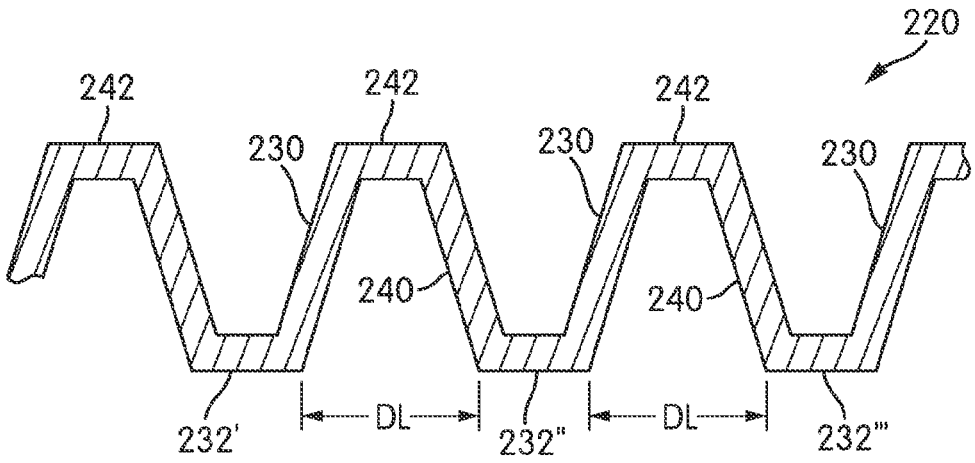
FIGS. 6A and 6B are schematic cross sections, viewed down the elongate axis of a channel, of sections of representative outsole portions illustrating certain aspects of the outsole portions in accordance with aspects of this disclosure.
Figure 6B:
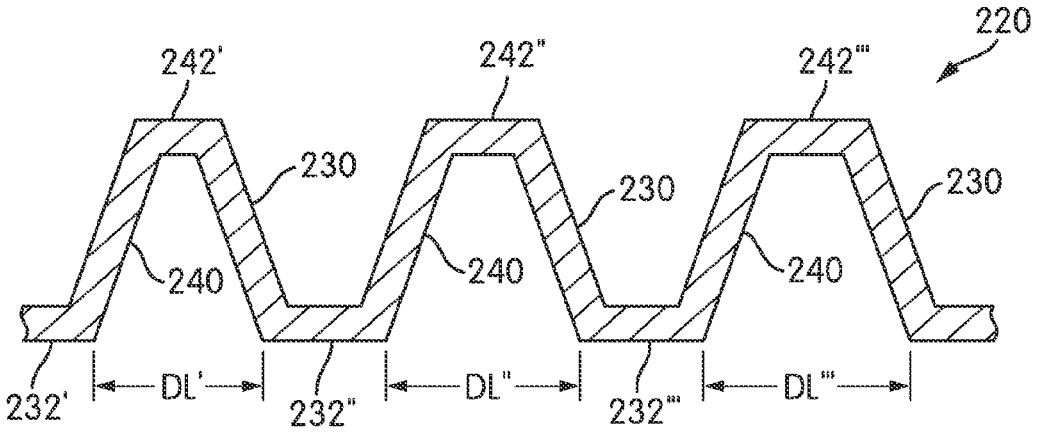

Referring in general to FIG. 4 and also to FIGS. 6A and 6B, the upper base elements 242 are spaced apart from one another a distance (DU), and the lower base elements 232 are spaced apart from one another a distance (DL). Referring to FIG. 4, the distance DU is shown as equal to the distance DL. For other embodiments, DU need not equal DL. Typically, the distance (DU, DL) between adjacent spaced apart base elements 232, 242 will be constant, such that the base elements 232, 242 are equally spaced from one another. For example, referring to FIG. 6A, the spacing DL between a first base element 232' and a second adjacent base element 232" is the same as the spacing DL between the second base element 232" and a third base element 232', and so on. Optionally, however, the distance (DU, DL) between the spaced apart, adjacent base elements 242, 232 need not be constant. Referring now to FIG. 6B, according to certain embodiments, base elements 232', 232", 232'" may be non-equally spaced from one another, i.e., the spacing DL' between a first base element 232' and a second base element 232' may be greater than the spacing DL" between the second base element 232" and a third base element 232'. The spacing (DU, DL) between the base elements 242, 232 may range from approximately 3.0 mm to approximately 10.0 mm. In order to minimize the weight of the outsole portion 220, the spacing (DU, DL) between the base elements 232, 242 may range from approximately 5.0 mm to approximately 10.0 mm or, more limited, from approximately 6.0 mm to approximately 8.0 mm. In order to increase the stiffness of the outsole portion 220, the spacing (DU, DL) between the base elements 232, 242 may range from approximately 3.0 mm to approximately 6.0 mm or, more limited, from approximately 4.0 mm to approximately 5.0 mm.

According to other aspects, the spacing (DU, DL) of the base elements 232, 242 between any two adjacent base elements may be constant along the elongated length of the base elements 232, 242 (and, thus, along the elongated length of the channels 230, 240), such that adjacent base elements (and adjacent channels) are arranged parallel (or substantially parallel) to one another. Optionally, however, the spacing (DU, DL) of the base elements 232, 242 need not be constant along the elongated length of the base elements, such that the base elements 232, 242 (and adjacent channels) may diverge from and/or converge toward one another. For example, referring to FIG. 9C, the spacing between upper base elements 242 decreases along the elongated length of the elements 242, i.e., $DU_1$ is greater than $DU_2$.

According to certain aspects of the invention, a plurality of the alternating upper and/or lower channels 230, 240 may undulate in the horizontal plane of the outsole structure 210. As shown in FIGS. 1B, 3A and 3B, on the bottom surface of the outsole portions 220, the lower base elements 232 and also the associated downward-facing channels 240 undulate across the plane of the outsole structure 210. Similarly, on the opposite, upper surface of the outsole portions 220, the upper base elements 242 and the associated channels 230 undulate across the plane of the outsole structure 210. As noted above and referring to FIGS. 3A and 3B, the plurality of upper base elements 242, in the aggregate, forms the top layer 222. Similarly, the plurality of lower base elements 232, in the aggregate, forms the bottom layer 224.

Referring to FIGS. 7A-7C and FIGS. 8A-8C, the undulating channels 230, 240 and/or the base elements 232, 242 (when viewed from above or from below) have a non-linear profile. In other words, the elongate axis (see FIG. 7A) of an undulating channel 230, 240 is not a straight line, i.e., the elongate axis of the undulating channel changes direction as the undulating channel 230, 240 extends from its first end 230*a*, 240*a* to its second end 230*b*, 240*b*. The undulations provide a three-dimensional aspect to the sidewalls 234, 244 of the channels 230, 240. In the situation where a channel and its sidewalls are non-undulating, i.e., a straight channel, the walls of the channel are formed as flat plates. Conversely, for undulating channels 230, 240 the sidewalls 234, 244 follow the undulations and are not flat. It is expected that this out-of-plane geometry that is imposed on the sidewalls 234, 244 by the undulations of the channels 230, 240 provides an additional stiffening mechanism. In the general case, the undulating channels 230, 240 (when viewed from above or from below) may have a zigzag profile, a sinusoidal profile, a sawtooth profile (i.e., an asymmetric version of a zigzag profile), a circular profile or any other curved or non-straight profile, whether regular or irregular.

Figure 7A:
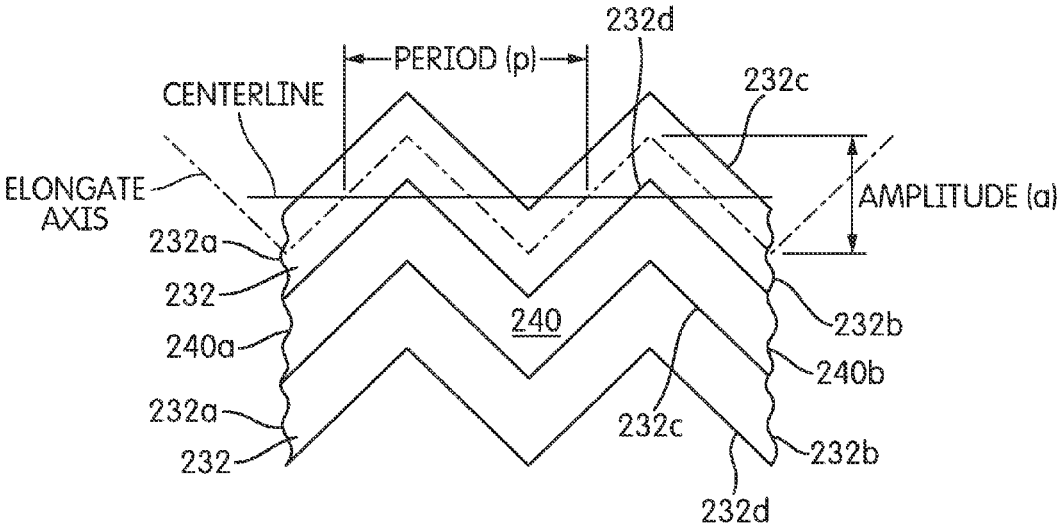
FIGS. 7A through 7C are simplified schematic bottom plan views of various alternative outsole portions in accordance with aspects of this disclosure.

As shown in FIG. 7A, the undulating channels 240 and the base elements 232 (when viewed from below) may have a zigzag profile. It is to be understood, that when viewed perpendicular to the plane of the sole, the undulating channels 230 and the base elements 242 would also have a zigzag profile. Further, as can be seen, the undulations of FIG. 7A are regular and cyclical. For example, a base element 232, 242 (and thus, its associated channel 240, 230) may be formed with a regular zigzag configuration, in that the period (p) and the amplitude (a) of the zigzag (in particular, the period and amplitude of the elongate axis of the zigzag) remain constant from the first end 232*a* to the second end 232*b*. By way of non-limiting examples, the period may range from approximately 10.0 mm to approximately 30.0 mm or from approximately 15.0 to approximately 25.0 mm. By way of non-limiting examples, the amplitude may range from approximately 2.0 mm to approximately 20.0 mm or from approximately 5.0 to approximately 15.0 mm.

Figure 7B:
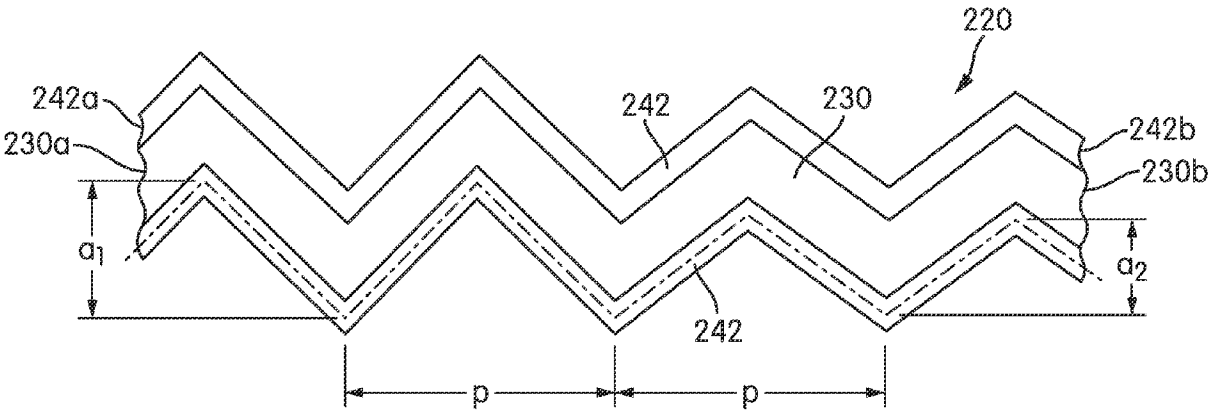
Figure 7C:
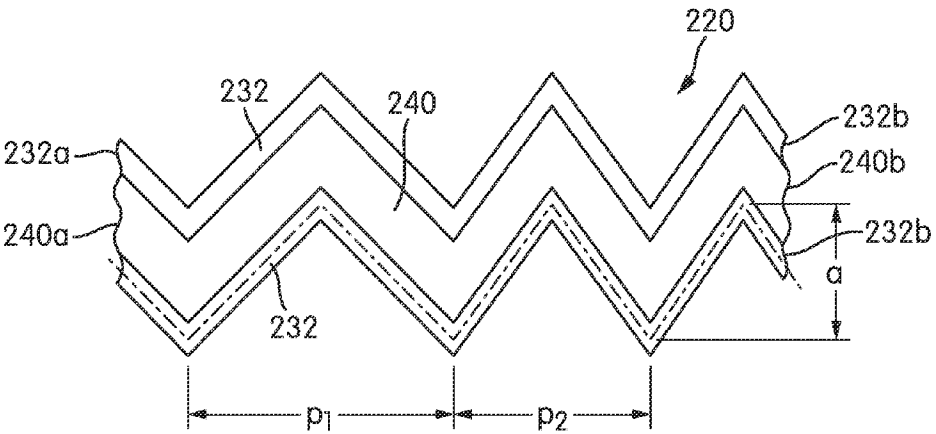

Optionally, the undulations in the plane of the sole may be irregular or even random. For example, as shown in FIG. 7B, the amplitude (a) of the elongate axis of the zigzag could vary—the amplitude (a) of the zigzag could increase and/or decrease—as the base elements 242 extend from the first ends 242*a* to the second ends 242*b* of the base elements 242 and the associated channel 230 extends from the first end 230*a* to the second end 230*b* of the channel 230. In FIG. 7B the amplitude is $a_1$ at end 242*a* and has decreased to $a_2$ at end 242*b*, while the period p has remained constant. As shown in FIG. 7C, the period (p) of the elongate axis of the zigzag could vary—the frequency of the zigzags could increase and/or decrease—as the base elements 232 and the associated channel 240 extend from the first ends 232*a*, 240*a* to the second ends 232*b*, 240*b*. In FIG. 7C the period $p_1$ is greater than the period $p_2$, while the amplitude (a) has remained constant. In the general case, the undulating channels 230, 240 (when viewed from above or from below) may have a zigzag profile, a sinusoidal profile, a sawtooth profile (i.e., an asymmetric version of a zigzag profile), a circular profile or any other curved or non-straight profile.

Figure 8A:
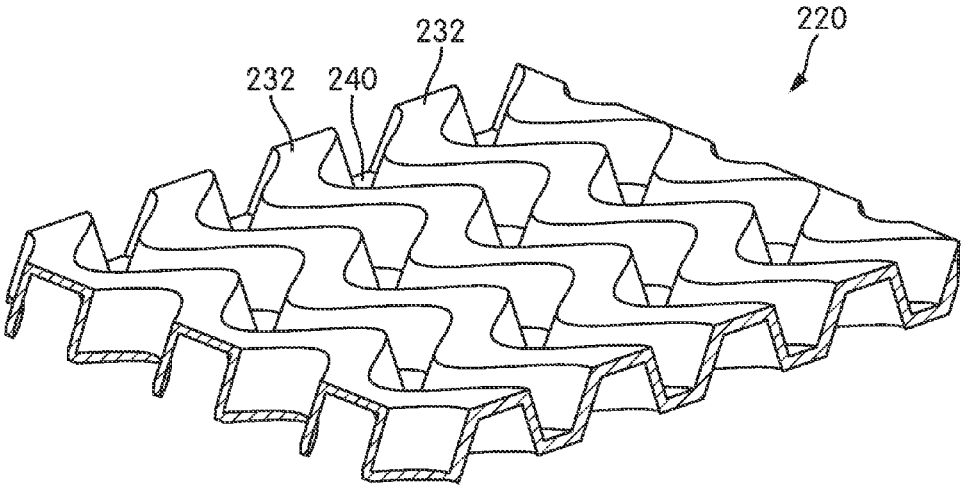
FIGS. 8A through 8C are perspective, cut-away, views of various alternative base element and channel configurations for representative outsole portions in accordance with aspects of this disclosure.

As shown in FIG. 8A, the undulating channels 240 and the base elements 232 (when viewed from below) may have a sinusoidal profile. Further, the undulations of FIG. 8A are regular and cyclical, although, as described above with respect to the zigzag channels of FIGS. 7A-7C, the period (p) and/or the amplitude (a) of the sinusoidal undulations need not be regular. Similarly, the undulating channels 230 and the base elements 242 (when viewed perpendicular to the plane of the sole) may have a sinusoidal profile.

Figure 8B:
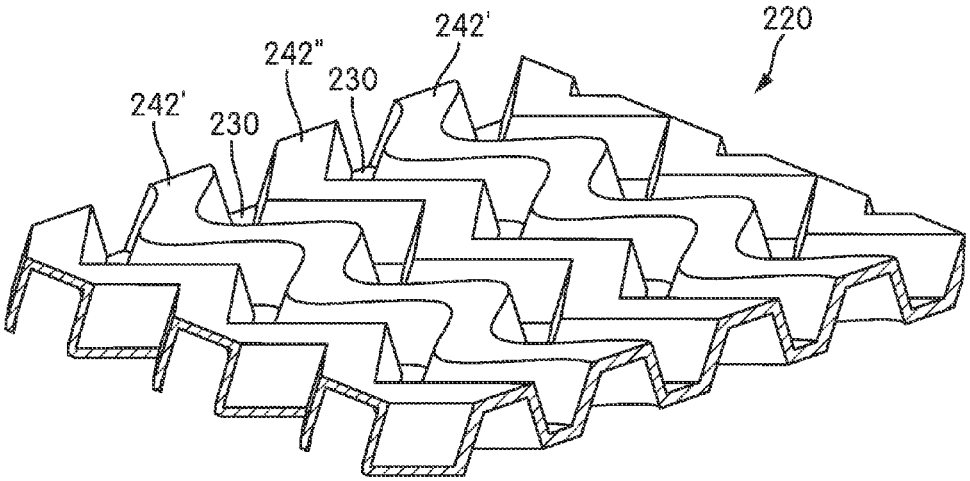

FIG. 8B illustrates an alternative embodiment of an outsole portion 220 wherein the base elements 232, 242 are formed with both sinusoidal and zigzag shapes. In this particular configuration, the sinusoidally-shaped base elements 242' alternate with zigzag-shaped base elements 242". Channel 230 is an undulating channel, but one of its sidewalls follows a sinusoidal path and the other of its sidewalls follows a zigzag path. Similarly, the undulating channels 240 and the base elements 232 (when viewed from below) may also be formed with alternating sinusoidal and zigzag shapes.

Figure 8C:
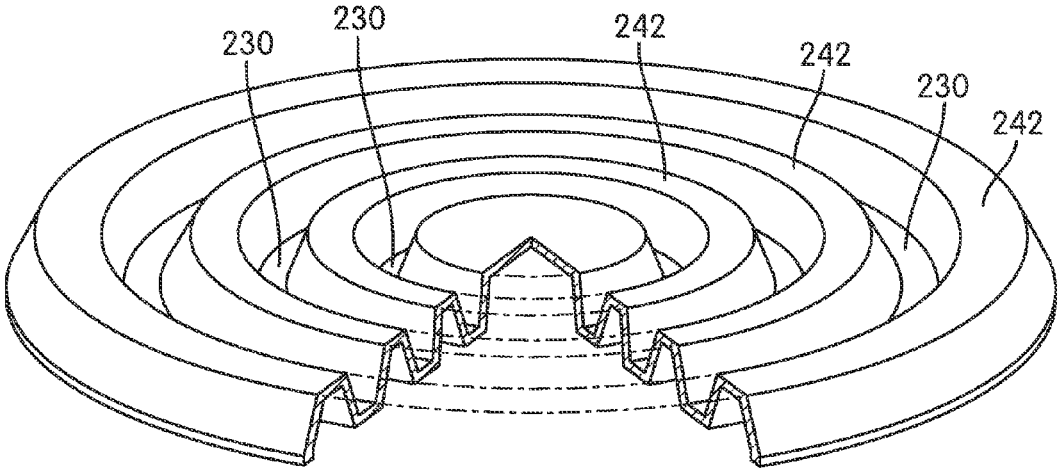

FIG. 8C illustrates another alternative embodiment of an outsole portion 220 wherein the base elements 232, 242 are formed as rings. In this particular configuration, the ring-shaped base elements 242 and ring-shaped channels 230 undulate around a closed loop. In other words, the elongate axis of a circular (or elliptical, ovoid, etc.) channel 230, 240 is not a straight line. Rather, the elongate axis of this circular undulating channel changes direction as the undulating channel 230, 240 extends from a first end to a second end. In the case of a closed loop, the first and second ends are coincident. Just as with the zigzag or sinusoidal undulations, the circular undulations provide a three-dimensional aspect to the sidewalls 234, 244 of the channels 230, 240. In certain alternative embodiments, the loop need not be closed, such that the base elements 232, 242 and channels 230, 240 may have a C-shaped profile, a hemispherical profile, a spiral profile, etc. (when viewed from above or below).

Thus, according to certain other aspects, a plurality of the upper base elements 242 may undulate in the substantially horizontal plane of the upper layer 222. Similarly, a plurality of the lower base elements 232 may undulate in the horizontal plane of the lower layer 224. In other words, when viewed from above (or below), each of the base elements 242, 232 that forms the top or bottom layer 222, 224 of the outsole portion 220 may have a nonlinear two-dimensional aspect along their elongated axis. In certain embodiments, for example as shown in FIGS. 3A and 3B, the undulating features of each of the base elements 232, 242 of the top and/or bottom layers 222, 224 of the outsole portions 220 are identical. In other words, each of the base elements 242 of the top layer 222 of an outsole portion 220 has an identical nonlinear configuration. Alternatively, the base elements 242 of the top layer 222 need not have identical configurations.

Figure 14A:
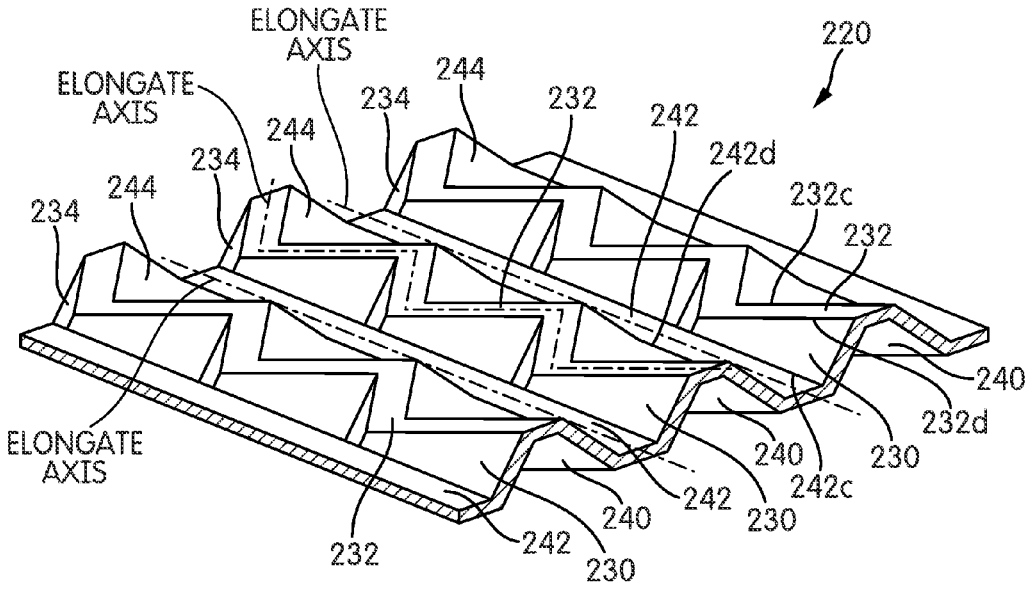
FIGS. 14A and 14B are simplified schematic bottom plan views of various alternative outsole portions in accordance with aspects of this disclosure.

Additionally, the undulating features of the base elements 242 of the top layer 222 may be identical to the undulating features of the base elements 232 of the bottom layer 224. However, in certain embodiments, the undulations of the upper base elements 242 need not be the same as the undulations of the lower base elements 232. Thus, in an example embodiment, the upper base elements 242 (when viewed perpendicular to the plane of the sole) may have a zigzag configuration, while the lower base elements 232 (when viewed from below) may be smoothly sinusoidal. As another example, the undulations of the upper base elements 242 may have an amplitude and/or a period that differs from the amplitude and/or period of the undulations of the lower base elements 232. Even further, the lower base elements 232 may undulate in the plane of the sole, while the upper base elements 242 do not (or vice versa). Thus, for example, as shown in FIG. 14A, the lower base elements 232 may undulate (as seen from below), while the upper base elements may extend straight without undulating across the outsole portion 220.

Figure 14B:
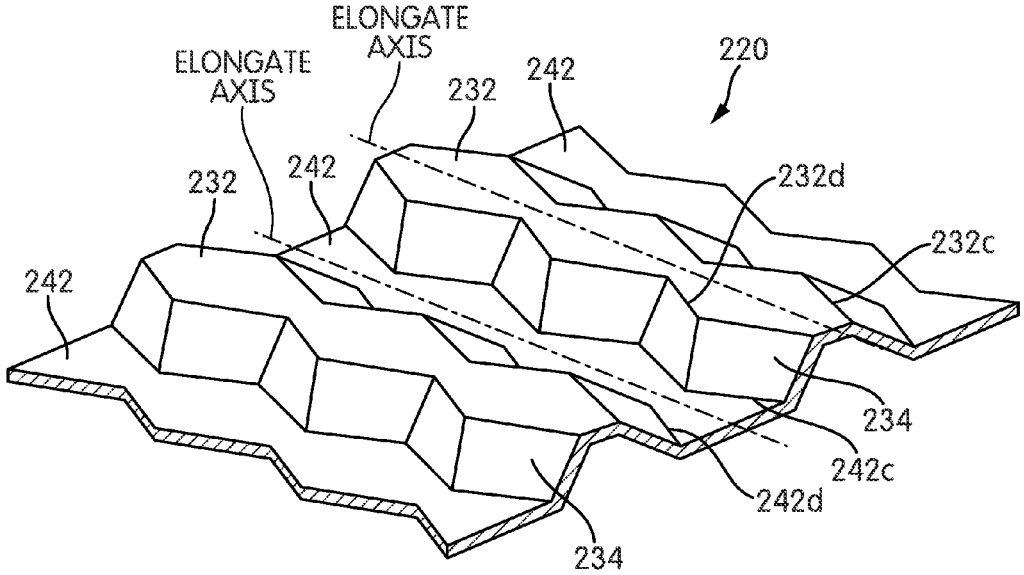

As even another alternative configuration and referring to FIG. 14B, the elongated axis of one or both of the lower base elements 232 and the upper base elements 242 may extend without undulating across the outsole portions 220 while the sidewalls 234, 244 undulate. This configuration is possible because, while the centerline (i.e., the elongated axis) of the base elements 232, 242 remains straight, the lengthwise edges 232*c*, 232*d*, 242*c*, 242*d* of the base elements 232, 242 undulate. The undulating lengthwise edges 232*c*, 232*c*, 242*c*, 242*d* provide a three-dimensional aspect to the sidewalls 234, 244 of the channels 230, 240 as the sidewalls extend down the length of the channels. The vertical slopes of the sidewalls 234, 244 may vary along the length of the channels. The horizontal slopes of the sidewalls 234, 244 may vary along the length of the channels. Picture a plane flying down a narrow valley, wherein to hug the sides of the hills forming the valley the plane must pitch and roll. In this manner, a twisting, rippling, rolling, three-dimensional geometry may be imposed on the sidewalls 234, 244 to thereby provide an additional stiffening mechanism.

With such non-symmetric undulating configurations, the sidewalls 234, 244 connecting the upper base elements 242 to the lower base elements 232 would generally have complex, curvilinear configurations. The sidewall elements 234, 244 may generally be considered to be planar, plate-like elements, i.e., having a length and/or a width that are considerably greater than their thickness (TS). However, it is to be understood that the sidewall elements 234, 244 may be flat, curved in one dimension (such as a cylindrical sidewall of a can would be) or doubly curved (such as a portion of a sphere). Most typically, the sidewalls 234, 244 will be linear in the vertical cross-sectional plane of the outsole structure 210 and either linear or curved along the length of the undulating channel 230, 240 (i.e., to follow the linear or curved undulations of the undulating base elements 232, 242 of the top and bottom layers 222, 224).

The top layer 222 and the bottom layer 224, and their associated undulating base elements 242, 232, may remain essentially planar. A person of ordinary skill in the art would understand that "essentially planar," in the context of the upper and lower layers 222, 224, encompasses slight curvatures or other out-of-plane geometries as would be in keeping with a sole structure 200 following the contours of a foot and allowing for a comfortable and/or efficient gait.

Thus, when viewed from the side, the individual base elements 242, 232 may also be essentially planar—the undulations of the base elements 232, 242 lie in the plane of the top (or bottom) layer 222, 224. In other words, as with the top (or bottom) layer 222, 224 as a whole, each base element 232, 242 may be essentially planar, with slight curvatures or out-of-plane geometries as would be in keeping with a sole structure following the contours of a foot.

Figure 15A:
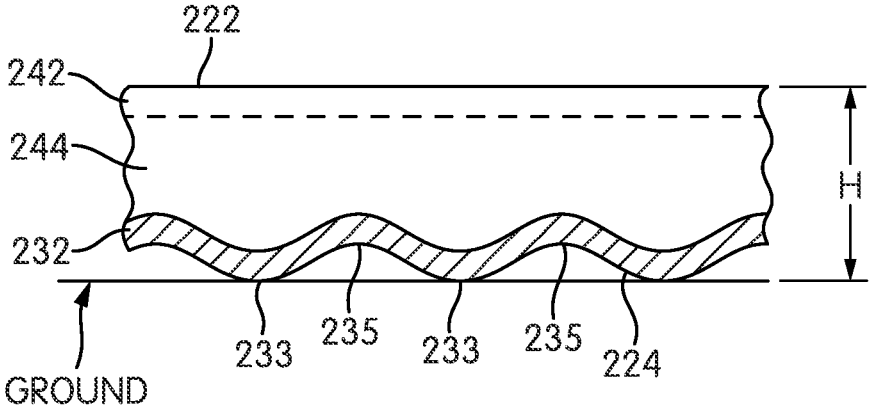
FIGS. 15A and 15B are schematic cross sections, viewed crosswise to the elongate axis of a channel and taken through a lower base element, of an alternative base element configuration illustrating an outsole portion in accordance with aspects of this disclosure.
Figure 15B:
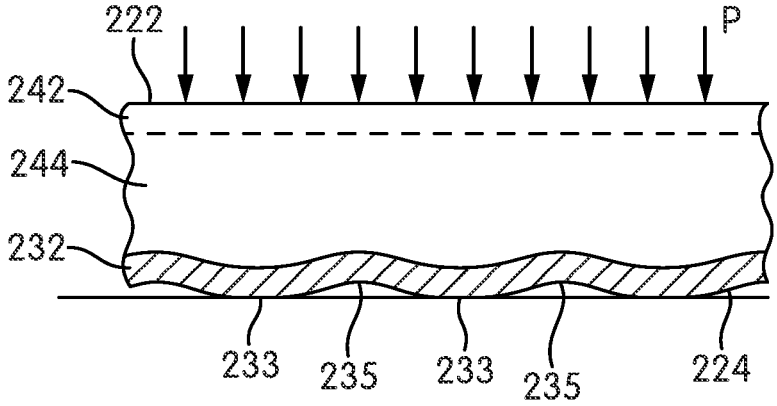

Alternatively, as shown in FIGS. 15A and 15B, undulations in the height (H) of the channels 230, 240 along the lengths of the channels 230, 240 may be reflected in vertical undulations of the lower base elements 232 (when viewed from the side, i.e., crosswise to the channels). As with the undulation of the base elements in-the-plane of the sole, the undulations of the base elements out-of-the-plane of the sole, the undulations may be regular or irregular and of any shape (zigzag, sinusoidal, stepped, jagged, rounded, angular, etc.). Due to the vertical undulations, the base elements 232 may have areas 233 that contact the ground and raised areas 235 that are displaced heightwise from the ground. Even further, the raised areas 235, i.e., those areas of the lower base elements 232 that are displaced heightwise from the ground in a "no-load" condition (refer to FIG. 15A), may be displaced downward when the sole portion is subjected to a pressure load (p) such that some or all of the previously raised areas come into contact with the ground (refer to FIG. 15B). Thus, according to some embodiments, the fraction area may vary as a function of pressure load.

Figure 9A:
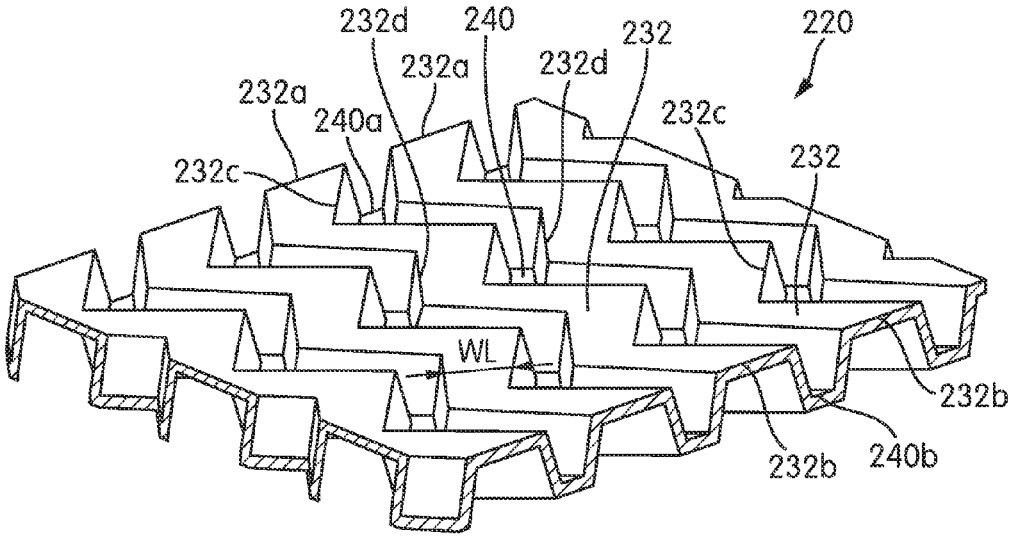
FIGS. 9A through 9C are perspective, cut-away,views of various alternative base element and channel configurations for representative outsole portions in accordance with aspects of this disclosure.
Figure 9B:
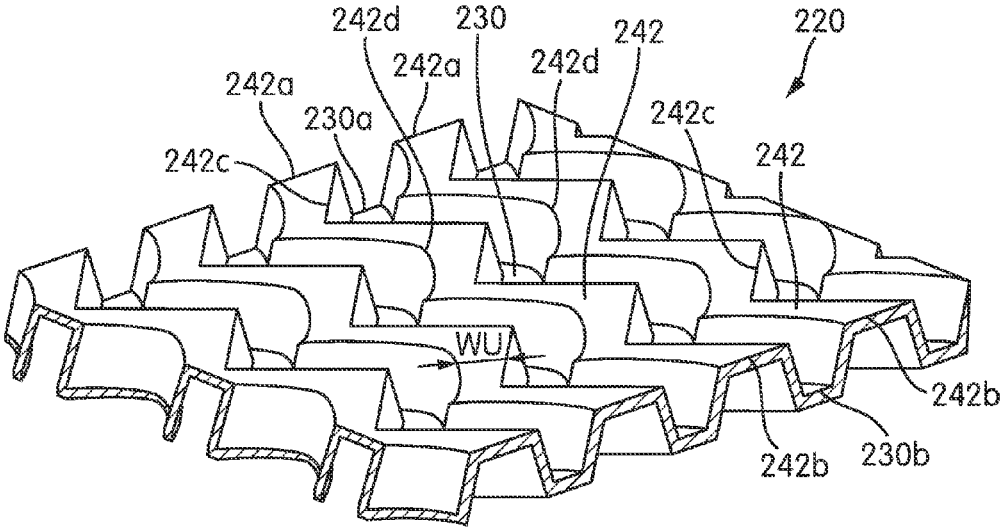
Figure 9C:
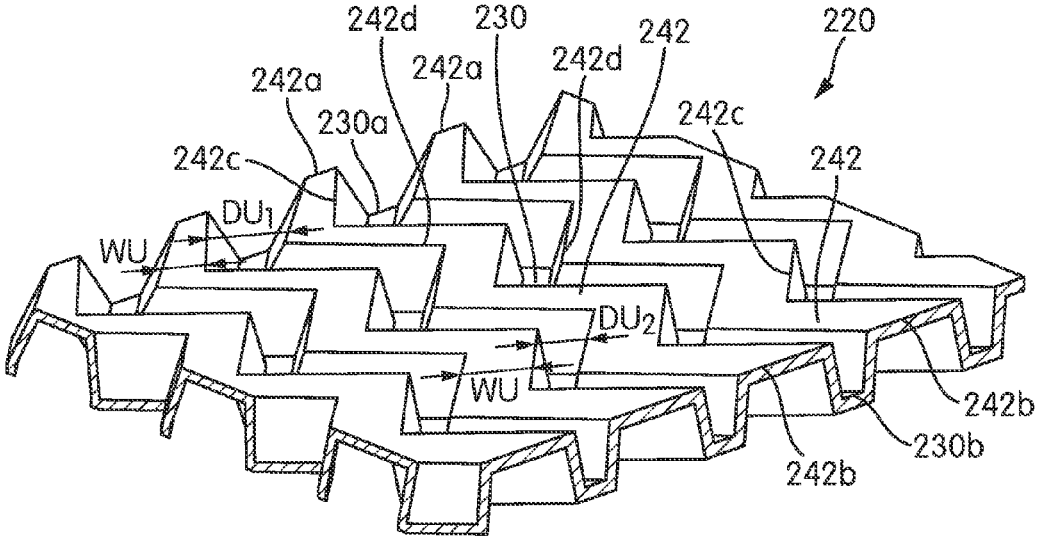

As discussed above and referring, for example, back to FIG. 4, the base elements 232, 242 may have a constant width or a non-constant width (WU, WL). Thus, an undulating base element may have a constant width. For example, as shown in FIG. 7A, a first edge 232*c* of the undulating base element 232 may have a zigzag profile and a second edge 232*d* of the undulating base element 232 may be formed with an identical zigzag profile. Alternatively, the undulating base elements 232, 242 may have a varying width (WU, WL). For example, as shown in FIG. 9A, a first edge 232*c* of the undulating base element 232 may have a relatively deep zigzag profile and the second edge 232*d* of the undulating base element 232 may have a shallower zigzag feature, such that the width (WL) of the undulating base element 232 increases and then decreases within the zigzag wavelength unit. As even another non-limiting example, referring to FIG. 9B, an undulating base element 242 may have a zigzag profile along a first edge 242*c* and half-sinusoidal profile along a second edge 242*d*, wherein the wavelength of the zigzag profile of the first edge 242*c* is the same as the wavelength of the half-sinusoidal profile along the second edge 242*d*. It can be seen that the width (WU) of the undulating base element 242 increases and then decreases nonlinearly within the zigzag wavelength unit. As a further non-limiting example, as shown in FIG. 9C, the profiles along the first and second edges 242*c*, 242*d* of an undulating base element 242 could be identical (for example, zigzag profiles), with the exception that, rather than running parallel to one another from the first end 242*a* to the second end 242*b* of the base element 242, the edges 242*c*, 242*d* gradually diverge from one another. Thus, in this example, the width (WU) of the base element 242 gradually increases as the element extends from the first end 242*a* to the second end 242*b*. Given the benefit of this disclosure, it becomes apparent that variations and/or combinations of these features may be combined.

Referring back to FIG. 1B, the outsole structure 210 could be formed as a single outsole portion 220. In this example, as viewed from below, the lower channels 240 of the outsole portion 220 undulate across the outsole structure 210 from the medial side 18 to the lateral side 17, and the plurality of lower channels 240 are arrayed in a series from the toe 14 to the heel 15. If viewed from above, the upper channels 230 of the outsole portion 220 would also be seen to undulate across the outsole structure 210 from the medial side 18 to the lateral side 17, and the plurality of upper channels 230 would be seen to be arrayed from the toe 14 to the heel 15. In this embodiment, at least a majority of the channels 240 (and the channels 230) continuously extend essentially across the outsole structure 210 from the lateral side 17 to the medial side 18 (e.g., at least 90% of this distance, and in some examples, at least 95% of this distance).

In certain embodiments, for example as shown in FIG. 1B, the channels 240 extend from their first ends 240*a* to their second ends 240*b* in a generally lateral-to-medial direction. Alternatively, it may be desirable for the channels 230, 240 to extend at an angle to the lateral-to-medial direction (see, e.g., outsole portion 220*a* in FIG. 11) or even in a generally longitudinal direction.

Figure 10:
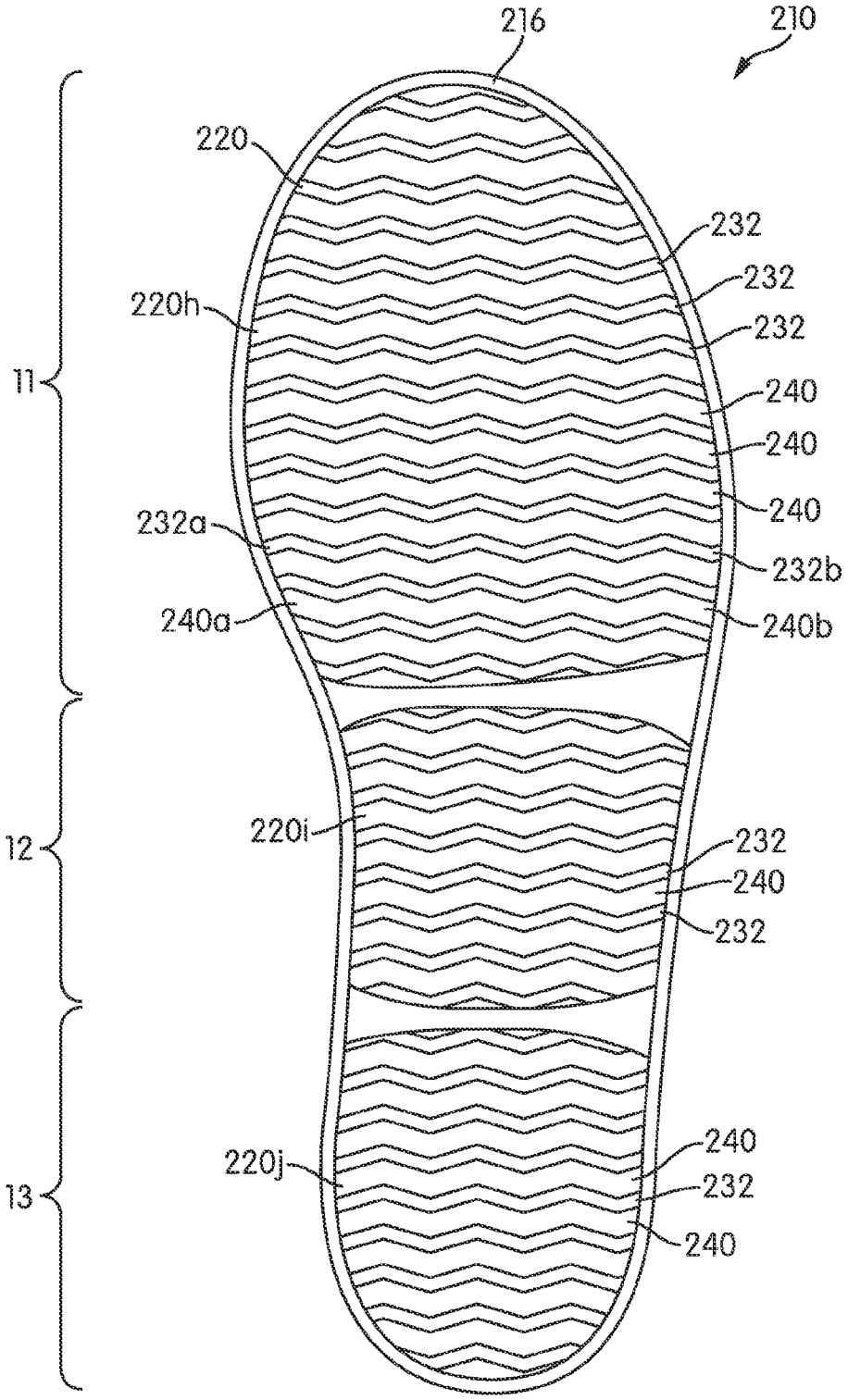
FIG. 10 is a bottom plan view of an outsole structure in accordance with certain aspects of this disclosure.
Figure 11:
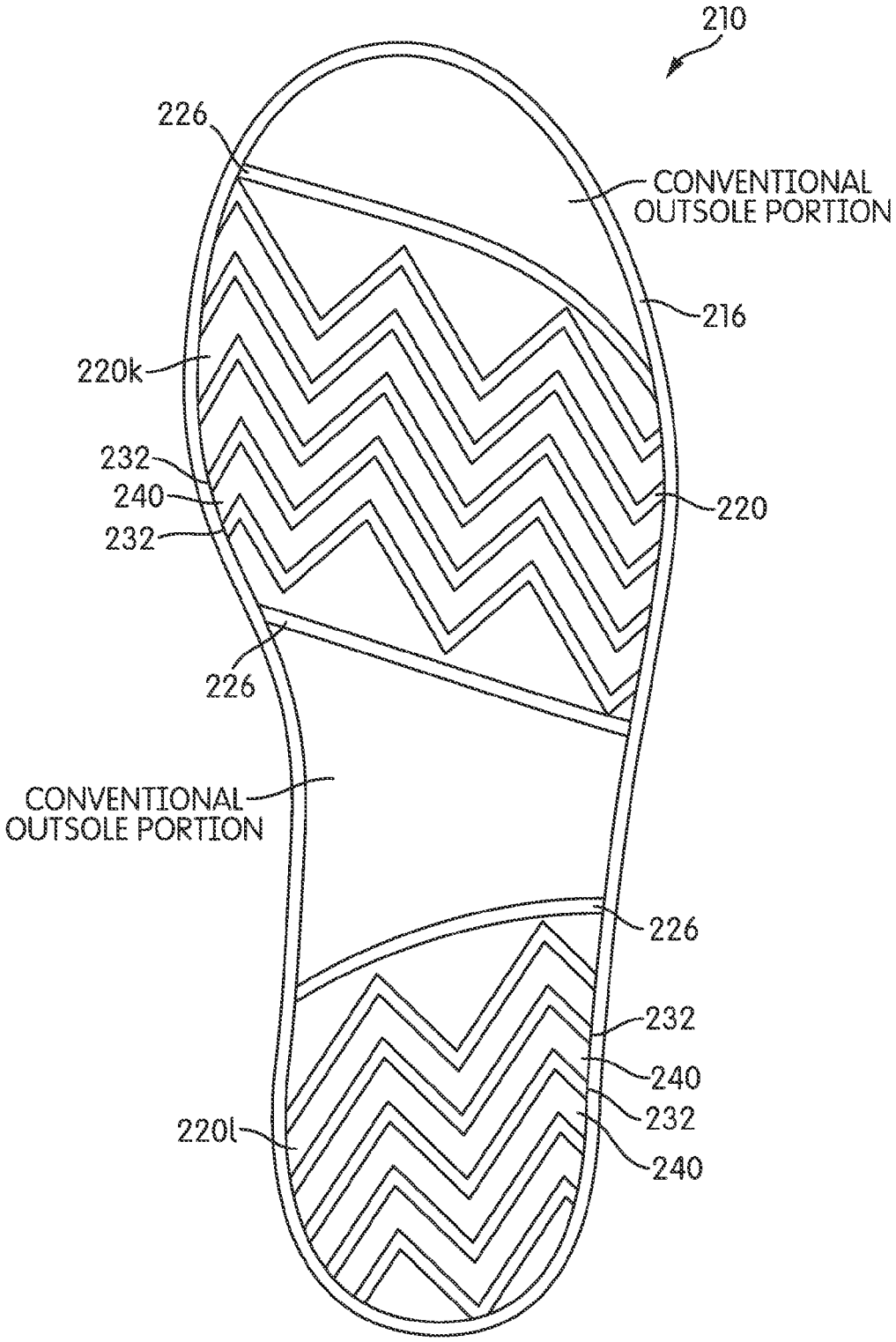
FIG. 11 is a bottom plan view of an outsole structure in accordance with certain aspects of this disclosure.
Figure 12:
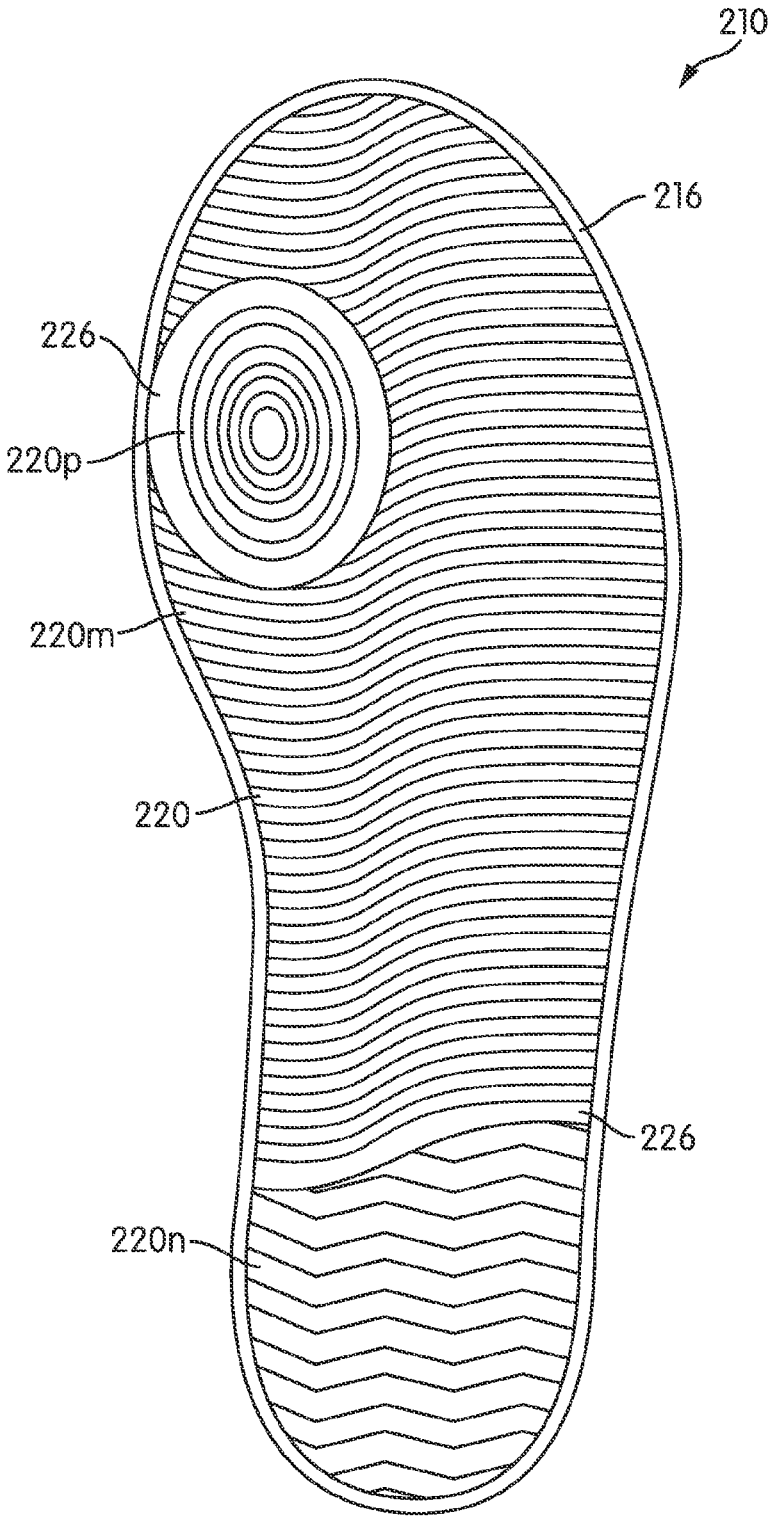
FIG. 12 is a bottom plan view of an outsole structure in accordance with certain aspects of this disclosure.

As noted above and referring to FIGS. 10, 11 and 12, according to certain aspects, the outsole structure 210 may include one or more outsole portions 220. Referring to FIG. 10, a first outsole portion 220*h* may be located in the forefoot region 11, a second outsole portion 220*i* may be located in the midfoot region 12, and a third outsole portion 220*j* may be located in the heel region 13. In such case, the first outsole portion 220*h* may be configured to be thinner and lighter weight than the third outsole portion 220*j*. According to certain embodiments, the third outsole portion 220*j* may be configured to react to greater impact loads than the first outsole portion 220*h*. Referring to FIG. 11, a first outsole portion 220*k* is located in the forefoot region and a second outsole portion 220*i* is located in the heel region. Referring to FIG. 12, a first outsole portion 220*m* is located in the forefoot and the midfoot regions, a second outsole portion 220*n* is located in the heel region and a third outsole portion 220*p* is located beneath the great toe in the forefoot region. Each of these three outsole portions 220*m*, 220*n*, 220*p* are provided with different geometries (TS, TU, TL, WU, WL, DU, DL, profiles, periods, amplitudes, etc.) so that these portions provide different impact-attenuation properties. In this way, the outsole structure 210 may be tailored to the expected conditions of use.

The one or more outsole portion 220*a*, 220*b*, 220*c*, etc. may cover at least a majority of the outsole area (e.g., at least 75% of the area, or even at least 85% or more of the area) of the outsole structure 210. Further, the one or more outsole portions 220 may be unitarily formed or, alternatively, the one or more outsole portions 220 may be made from different and/or separate pieces of material that are cemented or otherwise engaged to one another or with other portions of the outsole structure 210, if any.

Other conventional outsole configurations may also be provided within the outsole structure 210 where the one or more outsole regions 220, as disclosed herein, are not located. Thus, if desired, one or more regions of the outsole structure 210 may be provided without any channels 230, 240 or without any undulating elements 232, 242 without departing from the invention (see, for example, FIG. 11). These additional conventional outsole configurations, when present, may be unitarily formed with the outsole portions 220 as disclosed herein, or these additional conventional outsole configurations may be made from different and/or separate pieces of material that are cemented or otherwise engaged with the remainder of the outsole structure 210. These other conventional outsole configurations of the outsole structure 210 may be provided with or without a tread pattern, so as to give different traction, wear resistance, aesthetic appearance, logos or brand identifying information, and/or other desired properties or characteristics to various portions of the outsole structure 210.

The outsole portions 220 may further include a frame member 226 that extends around the perimeter of the outsole portion 220 and serves to connect the ends of the channels 230, 240 and/or the base elements 232, 242 together. The frame member 226 may lie in the same plane as the top layer 222 or the bottom layer 224. When the outsole structure 210 includes but a single outsole portion 220, the frame member 226 may extend around the perimeter of the outsole structure 210, which generally will coincide with the perimeter of the article of footwear.

Additionally, in one aspect, the outsole structure 210 may be a cupsole, formed as a single piece. According to this aspect, the outsole structure 210 may include a perimeter element 216 extending along at least a portion of the perimeter of the outsole structure 210. Typically, the perimeter element 216 forms a flange or sidewall that extends upward from the top layer 222 to form a structure that may cup and assist in retaining the upper 100 and/or the midsole 214, if any. The perimeter element 216 may be unitarily formed or co-molded with, or otherwise attached to, the top layer 222 or bottom layer 224. Further, the perimeter element 216 may also serve as a frame member 226 that connects the ends of the channels 230, 240 and/or base members 232, 242 together.

In operation, as the outsole structure 210 is initially compressed, energy is absorbed by the outsole structure's impact-attenuation system. As the outsole structure 210 is compressed even more, additional energy is absorbed by the system. For high-impact loading, it would be desirable to have a significant amount of energy absorbed by the system without the user's foot experiencing high impact loads. The disclosed impact-attenuation system provides a mechanism to absorb energy while at the same time minimizing or ameliorating the loads experienced by a user during the impact. As described below, the multi-regime outsole portions 220 disclosed herein may absorb significant amounts of energy, for example, as compared to conventional foamed midsoles with conventional outsoles, while minimizing or reducing the loads experienced by the user during the impact event.

Figure 13:
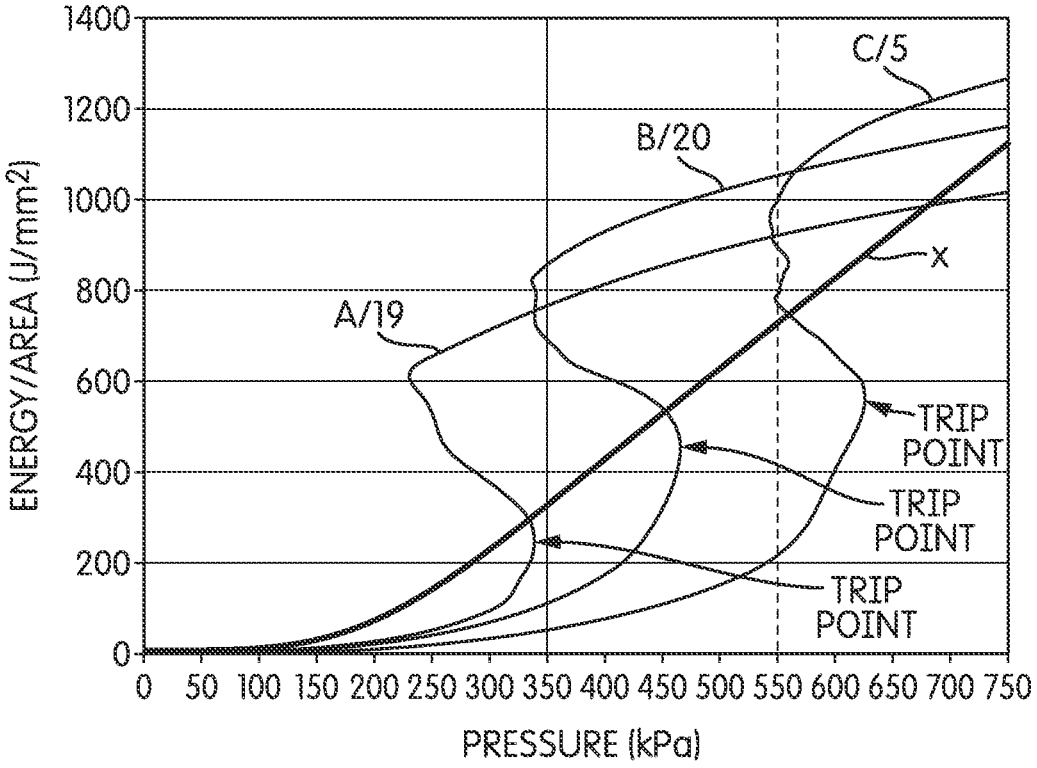
FIG. 13 is a graph of energy/area versus pressure for a set of exemplary embodiments of outsole portions in accordance with certain aspects of this disclosure.

Examples of energy absorption curves of various outsole portions 220 are shown in FIG. 13. This figure shows the total energy absorbed, based on finite element analyses, by the outsole portion per unit area as a function of pressure. As noted above, the pressure is determined using the overall gross area of the sole portion to which the load is applied, not just the specific net area of those elements of the sole portion contacted by the loading fixture (e.g., the area of just the upper base elements 242 of the channels). As a control, a 6 mm tall polyurethane foam block (injected Phylon) was tested in compression (curve X). In the pressure range of interest, the foam block essentially exhibits a linear response—as the pressure increases, the total energy per unit area proportionally increases. Three example energy absorption curves (A, B and C) for various outsole portion configurations according to the present disclosure are also presented in FIG. 13. Curve A is associated with sample 19 from Table I; curve B is associated with sample 20 from Table I; and curve C is associated with sample 5 from Table I.

Examining curve (A), it is seen that its "trip point" is from 300 kPa to 350 kPa, and that without exceeding the pressure of 350 kPa the outsole portion 220 associated with curve A absorbs from 700 J/mm$^2$ to 800 J/mm$^2$. In comparison, at a pressure of 350 kPa the foam block absorbs only about 330 J/mm$^2$. In other words, at a pressure of 350 kPa, the outsole portion associated with curve A absorbs more than twice (approximately 2.3 times) the energy per unit area as the control foam block. Even further, when the "trip point" pressure value is first reached (i.e., its first occurrence), the energy per unit area is approximately 300 J/mm$^2$, and when the "trip point" pressure value is next reached (i.e., its second occurrence), the energy per unit area is approximately 750 J/mm$^2$. Thus, from the first occurrence to the second occurrence of the "trip point" pressure value, the amount of energy absorbed by the outsole portion 220 associated with curve A has more than doubled.

Examining curve (B), it is seen that its "trip point" is from 450 kPa to 500 kPa, and that at a pressure of approximately 470 kPa the outsole portion 220 associated with curve B absorbs approximately 1000 J/mm$^2$—approximately 1.8 times the energy per unit area as the control foam block. Further, at a pressure of 550 kPa, the outsole portion absorbs from 1000 J/mm$^2$ to 1100 J/mm$^2$. In comparison, at a pressure of 550 kPa the foam block absorbs only about 740 J/mm$^2$. Even further, when the "trip point" pressure value is first reached (i.e., its first occurrence), the energy per unit area of curve B is approximately 450 J/mm$^2$, and when the "trip point" pressure value is next reached (i.e., its second occurrence), the energy per unit area is approximately 1000 J/mm$^2$. Thus, from the first occurrence to the second occurrence of the "trip point" pressure value, the amount of energy absorbed by the outsole portion 220 associated with curve B has increased by approximately 70%.

Examining curve (C), it is seen that its "trip point" is from 600 kPa to 650 kPa, and that at a pressure of 650 kPa the outsole portion 220 associated with curve C absorbs approximately 1200 J/mm$^2$—approximately 26% more energy per unit area as the control foam block. When the "trip point" pressure value is first reached (i.e., its first occurrence), the energy per unit area of curve C is approximately 600 J/mm$^2$, and when the "trip point" pressure value is next reached (i.e., its second occurrence), the energy per unit area is approximately 1150 J/mm$^2$. Thus, from the first occurrence to the second occurrence of the "trip point" pressure value, the amount of energy absorbed by the outsole portion 220 associated with curve C has increased by approximately 90%.

Another way of viewing the curves of FIG. 13 is to consider the total energy per unit area that must be absorbed due to any particular impact loading event. If the total energy from the impact loading event is, for example, approximately 700 J/mm$^2$, then the outsole portion 220 associated with curve A could absorb that amount of energy without ever exceeding a pressure loading of 350 kPa (approximately 335 kPa). In contrast, in order for the foam block (curve X) to absorb that amount of energy, a pressure loading exceeding 500 kPa (approximately 530 kPa) would be experienced. Thus, the outsole portion 220 associated with curve A achieves a pressure loading reduction of approximately 60% compared to the foam block for this scenario. Upon further examination of FIG. 13, it can be conservatively determined that the outsole portion 220 associated with curve A is capable of absorbing an energy per unit area of at least 600 J/mm$^2$ without exceeding a pressure of 350 kPa; that the outsole portion 220 associated with curve B is capable of absorbing an energy per unit area of at least 1000 J/mm$^2$ without exceeding a pressure of 500 kPa; and that the outsole portion 220 associated with curve C is capable of absorbing an energy per unit area of at least 1200 J/mm$^2$ without exceeding a pressure of 700 kPa.

The outsole structure 210 may be formed of conventional outsole materials, such as natural or synthetic rubber or a combination thereof. The material may be solid, foamed, filled, etc. or a combination thereof. One particular rubber may be a solid rubber having a Shore A hardness of 74-80. Another particular composite rubber mixture may include approximately 75% natural rubber and 25% synthetic rubber. The synthetic rubber could include a styrene-butadiene rubber. By way of non-limiting examples, other suitable polymeric materials for the outsole include plastics, such as PEBAX® (a poly-ether-block co-polyamide polymer available from Atofina Corporation of Puteaux, France), silicone, thermoplastic polyurethane (TPU), polypropylene, polyethylene, ethylvinylacetate, and styrene ethylbutylene styrene, etc. Optionally, the material of the outsole structure 210 may also include fillers or other components to tailor its wear, durability, abrasion-resistance, compressibility, stiffness and/or strength properties. Thus, for example, the outsole structure 210 may include reinforcing fibers, such as carbon fibers, glass fibers, graphite fibers, aramid fibers, basalt fibers, etc.

While any desired materials may be used for the outsole structure 210, in at least some examples, the rubber material of the outsole structure 210 may be somewhat softer than some conventional outsole materials (e.g., 50-55 Shore A rubber may be used), to additionally help provide the desired multi-regime characteristics. Optionally, if desired, a harder material (e.g., 60-65 Shore A rubber) may be used in the heel region and/or in certain medial regions.

Further, multiple different materials may be used to form the outsole structure 210 and/or the various outsole portions 220. For example, a first material may be used for the forefoot region 11 and a second material may be used in the heel region 13. Alternatively, a first material may be used to form the ground-contacting bottom layer 224 and a second material may be used to form the sidewalls 234, 244 and/or the top layer 222. The outsole structure 210 could be unitarily molded, co-molded, laminated, adhesively assembled, etc. As one non-limiting example, the ground-contacting layer 224 (or a portion of the ground-contacting bottom layer) could be formed separately from the sidewalls 234, 244 and/or the top layer 222 and subsequently integrated therewith.

The ground-contacting bottom layer 224 may be formed of a single material. Optionally, the ground-contacting bottom layer 224 may be formed of a plurality of sub-layers. For example, a relatively pliable layer may be paired with a more durable, abrasion resistant layer. By way of non-limiting examples, the abrasion resistant layer may be co-molded, laminated, adhesively attached or applied as a coating. Additionally, the material forming the abrasion resistant layer of the outsole structure 210 may be textured (or include texturing inclusions) to impart enhanced traction and slip resistance.

Further, with respect to another aspect of the disclosure, at least a portion of the outsole structure 210 may be provided with a grip enhancing material 218 to further enhance traction and slip resistance (see e.g., FIG. 1A). The grip enhancing material 218 may provide improved gripping properties as the foot moves and rolls along the skateboard, while the other portions of the outsole structure 210 may provide long term durability and wear resistance. Further, the grip enhancing material 218 may allow a larger area of the footwear to maintain contact with the skateboard as the foot moves and rolls along the board. Thus, for example, a relatively soft rubber or rubber-like component or a relatively soft thermoplastic material, such as a thermoplastic polyurethane (TPU), may be provided along the perimeter portion of forefoot region 11 of the outsole structure 210. In one particular embodiment, a softer durometer rubber may form an outer layer of the outsole structure 210 (e.g., a rubber having a hardness of 60 to 75 Shore A, possibly of 60 to 70 Shore A, and possibly of 64 to 70 Shore A), with a harder durometer rubber forming an inner layer (e.g., a rubber having a hardness of 70 to 90 Shore A, and possibly of 75 to 88 Shore A). Optionally, the enhanced gripping material may be co-molded, adhesively bonded, coated or otherwise provided on the outsole structure 210.

Figure 5F:
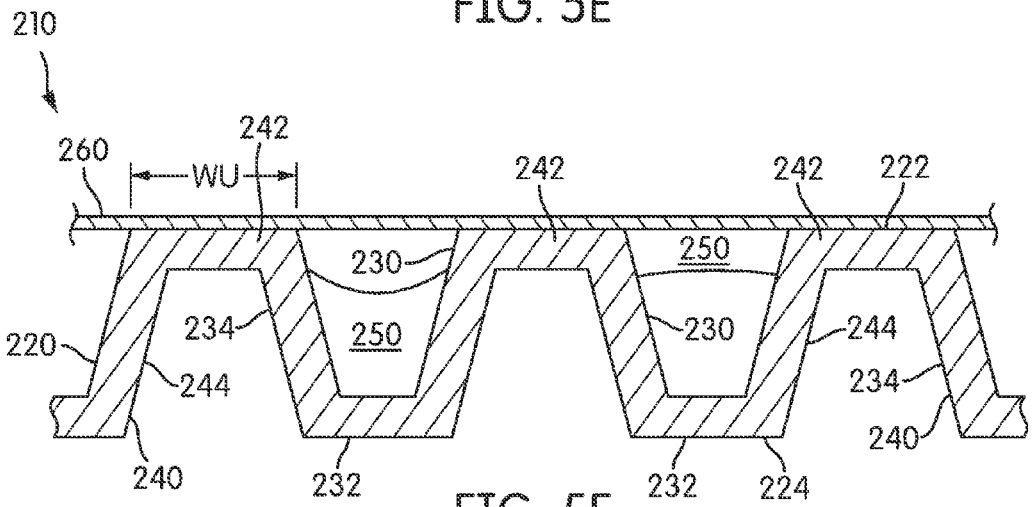

According to certain aspects and referring back to FIG. 5F, the sole structure 200 may further include a strobel 260. For instance, the top surface of the top layer 222 of the outsole structure 210 may be glued or otherwise affixed to a strobel 260. To assist in the attachment of the strobel 260 to the top layer 222, the width (WU) of the base elements 242 forming the top layer 222 may range from approximately 1.0 mm to approximately 5.0 mm, from approximately 2.0 mm to approximately 4.0 mm, or even from approximately 2.5 mm to approximately 3.5 mm. In certain embodiments, a width WU of from approximately 2.8 mm to approximately 3.2 mm may provide a suitable platform to which a strobel 260 may be glued or otherwise affixed.

Typically, a strobel 260 is a sole-shaped element that may include thin flexible materials, thicker and/or stiffer materials, compressible materials or a combination thereof to improve stability, flexibility and/or comfort. For example, the strobel 260 may include a cloth material, such as a woven or non-woven cloth supplied by Texon International, or a thin sheet of EVA foam for a more cushioned feel. An example strobel may be an EB-Strobel. The strobel 260 may have a thickness ranging from approximately 4.0 mm to approximately 10.0 mm, from approximately 5.0 to approximately 9.0 mm or even from approximately 6.0 to approximately 8.0 mm. For some applications, the strobel 260 would be thicker in the heel region than in the forefoot region. For certain applications, the strobel 260 may only be provided in the forefoot region, the midfoot region, the heel region, or select portions or combinations of these regions. A foam sockliner 212 such as described above, may be provided on top of the strobel 260.

It is to be understood that the addition of a strobel 260 or a sockliner 212 (or any other structure) will generally affect the stiffness characteristics of the outsole structure 210. Thus, the above discussion of outsole portions 220 and their stiffness characteristics is with respect to the outsole portions 220, in and of themselves, i.e., without the inclusion of any additional structure as may be part of the outsole structure 210 as a whole.

According to even other aspects of this disclosure and referring again to FIG. 5F, one or more fill elements 250, such as polymeric foam inserts, rubber-type inserts or air bladders, may be provided within the upward-facing channels 230 of the outsole portions 220. These fill elements 250 may contact and/or stabilize the sidewalls 234, 244 or portions of the sidewall. For example, a majority of the sidewall area of one or more of the upward-facing channels 230 may be in contact with relatively stiff, compressible, foam. As another example, only the portion of the sidewall 234, 244 closest to the top layer 222, i.e., the portion of the sidewall 234, 244 away from the ground-contacting, bottom layer 224 may be in contact with a fill element 250. Providing fill elements 250 may allow the compressive loads to be further diffused, while at the same time stabilizing portions of the outsole structure 220.

For example, if desired, fill elements 250 may include an impact-attenuating material that at least partially fills, and in some instances completely fills, at least some of the upwardly-facing channels 230 of an outsole region 220. This additional impact-attenuating material, which may be somewhat softer than the material from which the channel is constructed, can also help provide a smooth and comfortable surface for user foot contact while still transmitting forces to the bottom layer 224 and to the downwardly-facing channels 240. The impact-attenuating material may include relatively soft polyurethane or other foam material. The fill elements 250, if any, may be co-molded in conventional manners along with the molding process used to form the outsole structure 210 or the fill elements 250 may applied to the outsole structure 210 in a separate manufacturing operation. The strobel 260 and the fill elements 250 are separate elements that may be provided independently of each other.

Figure 5G:
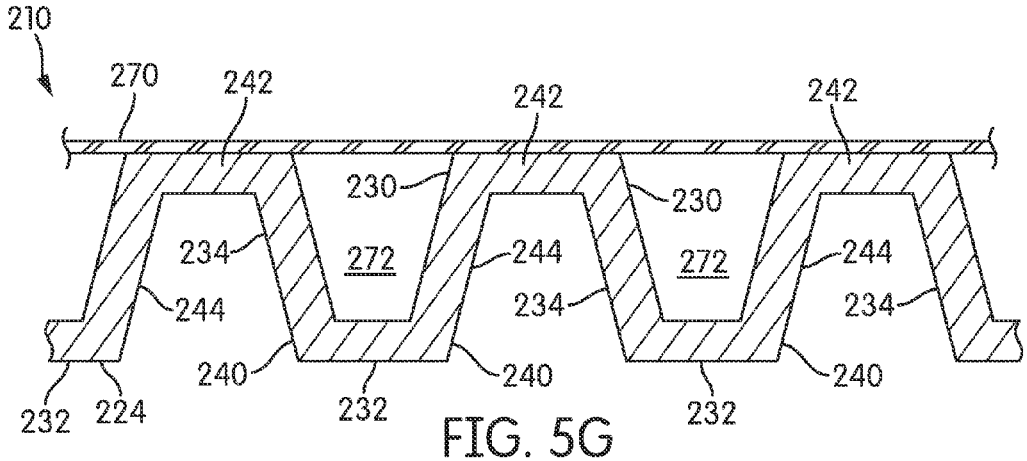

Even further as shown in FIG. 5G, the outsole structure 210 may optionally be provided with an impermeable layer 270 that is sealed to the top surface of the top layer 222, to the frame member 216, if any (see e.g., FIG. 11) and/or to the perimeter member 226 (see e.g., FIG. 11) of the outsole structure 210. Such an impermeable layer 270 need not extend completely over the entire outsole structure 210, but may be located in one or more regions (11, 12, 13, etc.) or portions of regions of the outsole structure 210. As a non-limiting example, the impermeable layer 270 may be located in the heel region 13 and/or in the forefoot region 13, but not in the midfoot region 12. The upper layer-to-outsole seal may form a fluid-tight seal that defines one or more fluid-tight chambers 272. These fluid-tight chambers 272 are defined by the upper channels 230 and the impermeable layer 270. The fluid-tight chambers 272 may accommodate and retain air (or other gas, positively pressurized or not) or a liquid (for example, water, positively pressurized or not). Thus, in essence, an outsole structure 210 with a sealed impermeable layer 270 would form at least one interior chamber 272 that may function as a fluid bladder and thereby assist in carrying and distributing loads.

Thus, from the above disclosure it can be seen that the enhanced impact-attenuation system due to the outsole portions 220 as disclosed herein provides better impact protection, while not sacrificing feel, for a wearer of the article of footwear. During use, one or more of the channels 230, 240 provide support for the wearer's foot. The channels 230, 240 in a first, unbuckled configuration carry or react at least some of the vertical, compressive load transmitted from the wearer to the ground. Thus, according to certain aspects of the disclosure, the channels 230, 240 in a first pressure-versus-displacement regime are designed to elastically react vertical compressive loads. In this first regime, the pressure versus displacement curve may be relatively stiff such that the wearer is able to get a good "feel" for the engaged surface. When a "trip point" load is reached, the channels 230, 240 are designed to assume a second, buckled, configuration. In such a second pressure-versus-displacement regime, the channels 230, 240 are designed to compliantly absorb additional impact energy without substantially any additional increase in load (for a given change in displacement). At some point in the post "trip point" regime, the buckling of the sidewalls 234, 244 will be at least partially arrested or physically limited and the stiffness of the outsole portion 220 will start to increase. For example, two adjacent sidewalls 234, 244 may lateral deflect until they contact one another, at which point, the lateral deflection of one sidewall will serve to limit the lateral deflection of the other sidewall (and vice versa). Upon release of the load, the channels 230, 240 return to their original configuration, without any permanent set or deformation. If the impact energy to be dissipated is great enough, the channels 230, 240 will eventually essentially "bottom out," and the load experience by the wearer's foot in this third pressure-versus-displacement regime may increase above the "trip point" load.

The "trip point" load may be selected such that under normal walking or usage conditions the "trip point" is not reached. In other words, the channels 230, 240 may be designed with a high enough "trip point" such that the "trip point" is only achieved under relatively high impact loads. Further, the "trip point" may be selected based on expected loading events and peak pressure distributions under the foot. So, for example, for a skateboard shoe a target "trip point" of 350 kPa (+/−50 kPa, +/−75 kPa, or even +/−100 kPa) may be selected to accommodate expected loads during high impact tricks in the forefoot region of the foot, while a target "trip point" of 550 kPa (+/−50 kPa, +/−75 kPa, or even +/−100 kPa) may be selected to accommodate expected loads during high impact tricks in the heel region of the foot. Other "trip points" could be selected based on the expected impact event.

The disclosed multi-stage or multi-zoned vertical stiffness profile of this disclosed impact-attenuation system allows impact loading associated with normal activities such as walking to be reacted by the stiffer configuration of the outsole portions 220, thereby providing greater "feel" for the ground during low impact operation. The greater impact loading associated with jumping and tricks may be partly reacted by the softer, buckled, configuration of the outsole portions 220, thereby providing a "high-impact cushioning system," i.e., a stiffness regime that provides superior protection for the wearer during such high impact activities.

This disclosed impact-attenuation system allows the sole structure 200 to be tailored to the specific application. The stiffness and compression characteristics (and particularly, the pressure-versus-displacement curves) of any particular outsole portion 220 is a function not only of its material (as would be the case with conventional cushions and foams) but also of its geometry. Thus, in essence, the geometry of the outsole portions 220 may be selected so that a particular pressure-versus-displacement characteristic may be achieved in the first regime, a desired "trip point" may be design to, and the post-buckling pressure-versus-displacement characteristics in the second regime may be tailored so that the expected impact energy is reacted without exceeding the desired "trip point" a second time. For certain embodiments, as compared to a sole structure having a solid foam midsole, the outsole portions 220 may be designed to be initially stiffer, but then softer than a solid foam midsole sole structure.

Thus, according to certain aspects, under expected low-impact loading conditions, the outsole portions 220 could be designed to act like a conventional, relatively stiff sole. Loads reacted at the ground (or other engaged surface) would be transmitted through the sole with relatively little attenuation such that a user would "feel" the reaction loads. Under high-impact loading conditions (i.e., when the "trip point" is reached), the sidewalls 234, 244 could be designed to buckle, resulting in a relatively short vertical displacement of the outsole portion 220 under a reduced (or possibly the same) pressure. During this buckling, post "trip point" regime, the user would feel a softening of the sole and experience a corresponding cushioning or "sinking-in" feel. Although the user will lose some "feel" for the ground during this "sinking-in" period, the loads experienced by the user will be attenuated, thus protecting the user's foot from injury. As the vertical displacement increases, at some point it is expected that the user will start to experience increasing reaction loads. Bottoming out occurs when the deflection due to buckling has reached it maximum, at which point impact force attenuation would be achieved by compression of the material of the outsole portion 220.

While the invention has been described with respect to specific examples including presently preferred modes of carrying out the invention, those skilled in the art, given the benefit of this disclosure, will appreciate that there are numerous variations and permutations of the above described structures, systems and techniques that fall within the spirit and scope of the invention as set forth above. Thus, for example, a wide variety of materials, having various properties, i.e., flexibility, hardness, durability, etc., may be used without departing from the invention. Finally, all examples, whether preceded by "for example," "such as," "including," or other itemizing terms, or followed by "etc.," are meant to be non-limiting examples, unless otherwise stated or obvious from the context of the specification.

We claim:

1. A sole structure for an article of footwear, the sole structure comprising:

one or more outsole portions, a first outsole portion having:

a plurality of alternating upward-facing and downward-facing elongate channels;

wherein each channel has a base element and two sidewalls, with adjacent upward-facing and downward-facing channels sharing a common sidewall, wherein the base elements of the downward-facing channels form an upper surface of the first outsole portion and the base elements of the upward-facing channels form a lower surface of the first outsole portion, the base elements that form the lower surface extend across the first outsole portion in a non-linear configuration when viewed from below, and wherein a thickness of the base element and sidewalls, the non-linear configuration, and a material from which the first outsole portion is formed, combine to provide the first outsole portion with a pressure-versus-strain curve having a first occurrence of a first pressure value at a first strain value where buckling of the first outsole portion occurs under a compressive load, and a second occurrence of the first pressure value at a second strain value that is larger than the first strain value, wherein the difference between the second strain value and the first strain value is at least 10%.

2. The sole structure of claim 1, wherein the difference between the second strain value and the first strain value is at least 20%.

3. The sole structure of claim 1, wherein the pressure-versus-strain curve of the first outsole portion has a second pressure value between the first strain and the second strain that occurs when buckling of the first outsole portion stops, and wherein the second pressure value is greater than 70% of the first pressure value.

4. The sole structure of claim 1, wherein a thickness of the base element and sidewalls, the non-linear configuration, and a material from which the first outsole portion is formed combine to allow the first outsole portion to absorb a first amount of energy per unit area at the first occurrence of the first pressure value and absorbs a second amount of energy per unit area at a second occurrence of the first pressure value, and wherein the value of the second energy per unit area is at least 170% of the value of the first energy per unit area.

5. The sole structure of claim 1, wherein the first outsole portion has a height of less than or equal to 10.0 mm, measured from the upper surface to the lower surface.

6. The sole structure of claim 5, wherein a thickness of the base element and sidewalls, the non-linear configuration, and a material from which the first outsole portion is formed combine to allow the first outsole portion to absorb an energy per unit area of at least 600 J/mm$^2$ without exceeding a pressure of 350 kPa.

7. The sole structure of claim 5, wherein a thickness of the base element and sidewalls, the non-linear configuration, and a material from which the first outsole portion is formed combine to allow the first outsole portion to absorb an energy per unit area of at least 900 J/mm$^2$ without exceeding a pressure of 500 kPa.

8. The sole structure of claim 5, wherein a thickness of the base element and sidewalls, the non-linear configuration, and a material from which the first outsole portion is formed combine to allow the first outsole portion to absorb an energy per unit area of at least 1100 J/mm$^2$ without exceeding a pressure of 700 kPa.

9. The sole structure of claim 1, wherein the first outsole portion has a height of from approximately 6.0 mm to approximately 12.0 mm, measured from the upper surface to the lower surface.

10. The sole structure of claim 1, wherein the first outsole portion has a "trip point" pressure value of between 250 kPa and 450 kPa.

11. The sole structure of claim 1, wherein the first outsole portion has a "trip point" pressure value of between 450 kPa and 650 kPa.

12. The sole structure of claim 1, wherein, when viewed perpendicular to a plane of the sole, the base elements of the upward-facing channels of the first outsole portion undulate.

13. The sole structure of claim 1, wherein, when viewed perpendicular to a plane of the sole, the base elements of the upward-facing channels of the first outsole portion have a zigzag configuration.

14. The sole structure of claim 1, wherein, when viewed perpendicular to a plane of the sole, the sidewalls of the channels of the first outsole portion undulate.

15. The sole structure of claim 1, wherein, when viewed from the side, the base elements of the upward-facing channels of the first outsole portion vertically undulate.

16. The sole structure of claim 1, further including a strobel affixed to the top surface of the first outsole portion.

17. The sole structure of claim 1, wherein the first outsole portion is located in a heel region of the sole structure and has a "trip point" pressure value between 450 kPa and 650 kPa.

18. The sole structure of claim 1, wherein the first outsole portion is located in a forefoot region of the sole structure and the first pressure value is between 250 kPa to approximately 450 kPa.

19. The sole structure of claim 1, wherein the angles of the sidewalls to the upper surface of the first outsole portion are greater than or equal to 70 degrees.

20. The sole structure of claim 1, wherein widths of the base elements of the downward-facing channels of the first outsole portion are greater than 2.0 mm and wherein widths of the base elements of the upward-facing channels of the first outsole portion are less than 1.5 mm.

21. The sole structure to claim 1, wherein the widths of the base elements of the downward-facing channels of the first outsole portion are between 2.5 mm to 3.5 mm and wherein the widths of the base elements of the upward-facing channels of the first outsole portion are between 1.0 mm to 1.5 mm.

22. The sole structure of claim 1, wherein thicknesses of the sidewalls of the first outsole portion are between 0.8 mm and 1.5 mm.

23. The sole structure of claim 1, wherein thicknesses of the base elements of the upward-facing channels of the first outsole portion are between 1.0 mm and approximately 1.5 mm.

* * * * *